US009588452B2

(12) United States Patent
Fujisaki et al.

(10) Patent No.: US 9,588,452 B2
(45) Date of Patent: Mar. 7, 2017

(54) TONER FOR DEVELOPING ELECTROSTATIC LATENT IMAGE AND PROCESS FOR PRODUCING THE SAME

(71) Applicant: Konica Minolta, Inc., Tokyo (JP)

(72) Inventors: Tatsuya Fujisaki, Tokyo (JP); Junya Onishi, Tokyo (JP); Naoya Tonegawa, Kanagawa (JP); Shiro Hirano, Tokyo (JP); Hidehito Haruki, Tokyo (JP); Tatsuya Nagase, Tokyo (JP)

(73) Assignee: KONICA MINOLTA, INC., Tokyo (JP)

( * ) Notice: Subject to any disclaimer, the term of this patent is extended or adjusted under 35 U.S.C. 154(b) by 0 days.

(21) Appl. No.: 14/846,038

(22) Filed: Sep. 4, 2015

(65) Prior Publication Data

US 2016/0070188 A1 Mar. 10, 2016

(30) Foreign Application Priority Data

Sep. 8, 2014 (JP) ..... 2014-182095

(51) Int. Cl.
*G03G 9/087* (2006.01)
*G03G 9/08* (2006.01)

(52) U.S. Cl.
CPC ..... *G03G 9/08755* (2013.01); *G03G 9/0806* (2013.01)

(58) Field of Classification Search
CPC ..... G03G 9/08755; G03G 9/08711
See application file for complete search history.

(56) References Cited

U.S. PATENT DOCUMENTS 9,423,712 B2 * 8/2016 Sugama ..... G03G 9/08733

FOREIGN PATENT DOCUMENTS

| | | | |
|---|---|---|---|
| JP | 2005-301178 | A | 10/2005 |
| JP | 2005-338548 | A | 12/2005 |
| JP | 2006-002109 | A | 1/2006 |
| JP | 2012189940 | A | 10/2012 |
| JP | 2012-255957 | A | 12/2012 |
| JP | 2013109246 | A | 6/2013 |

OTHER PUBLICATIONS

Notice of Reasons for Rejection dated Sep. 27, 2016 from corresponding Japanese Application; Patent Application No. 2014-182095; English translation of Notice of Reasons for Rejection; Total of 9 pages.

* cited by examiner

*Primary Examiner* — Hoa V Le
(74) *Attorney, Agent, or Firm* — Lucas & Mercanti, LLP

(57) ABSTRACT

The toner according to the present invention comprises a matrix phase composed of a vinyl resin, and domain phases composed of a non-crystalline polyester resin dispersed in the matrix phase, and a number-average domain diameter of the domain phases composed of the non-crystalline polyester resin is 30 to 150 nm. The toner satisfies relation represented by a specific requirement of the total area of the domain phases present in a surface layer area of the toner particle, and the total area of the domain phases present in areas other than the surface layer area, in a given cross-section of the toner particle.

16 Claims, 1 Drawing Sheet

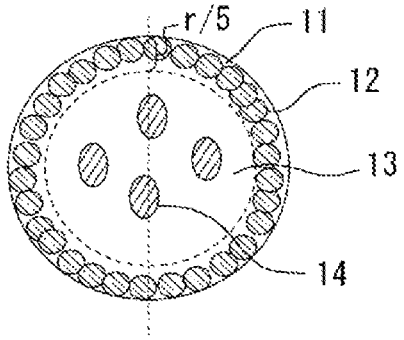
r/5
11
12
13
14

TONER FOR DEVELOPING ELECTROSTATIC LATENT IMAGE AND PROCESS FOR PRODUCING THE SAME

CROSS REFERENCE TO RELATED APPLICATIONS

This application is entitled to and claims the benefit of Japanese Patent Application No. 2014-182095, filed on Sep. 8, 2014, the disclosure of which including the specification, drawings and abstract is incorporated herein by reference in its entirety.

BACKGROUND OF THE INVENTION

Field of the Invention

The present invention relates to a toner for developing an electrostatic latent image for forming an electrophotographic image, and a process for producing the same.

Description of Related Art

Recently, in the field of electrophotographic image forming apparatus, toner for developing an electrostatic latent image (hereinafter also referred simply as "toner") suitable for electrophotographic image formation has been developed in response to the demand of the market. For example, as toners for providing a high-quality image, such toners have been required that have a sharp particle size distribution, i.e., toners that have uniform toner particle diameters. In such toners, each individual toner particle exhibits uniform development behavior and thereby the reproducibility of fine dots remarkably improves. However, it is not easy to make the toner particle diameter distribution sharper with conventional toner production methods using the pulverization method. To address this problem, the emulsion aggregation method has been used as a method capable of controlling toner particles to have any desired shape and particle size distribution. The emulsion aggregation method is a method of obtaining toner particles wherein resin microparticles and colorant microparticles, together with release agent microparticles as necessary, are aggregated by addition of an aggregation agent or by pH control while mixing and stirring, and the aggregated microparticles are further fused together under heating.

Further, the development of low-temperature fixable toners, which can be fixed with lesser energy, has been in progress from the viewpoint of energy-saving. In order to lower the fixing temperature of toner, it is necessary to lower the melt temperature or melt viscosity of the binder resin. However, when the glass transition point or molecular weight of the binder resin is lowered for the purpose of lowering the melt temperature or melt viscosity of the binder resin, new problems arise such as low toner high-temperature storability and/or low separability of sheet from the fixing member upon fixation (hereinafter simply referred to as "separability").

In order to achieve both low-temperature fixability and high-temperature storability, it has been common practice to allow toner particles to have a core-shell structure (see, e.g., Japanese Patent Application Laid-Open No. 2012-189940). That is, the formation of a shell layer composed of resin that exhibits excellent high-temperature storability and high softening point on the surface of core particles composed of binder resin that exerts excellent effects in low-temperature fixability can provide both low-temperature fixability and high-temperature storability. In particular, such a core-shell structure can be easily formed when the emulsion aggregation method is used.

As such a toner having toner particles with a core-shell structure, toners have been developed that include a polyester resin as the resin constituting the shell layer. Since the polyester resin can be advantageously easily designed to have a lower softening point while maintaining a higher glass transition point as compared to styrene acrylic resins, it is possible to obtain a toner excellent both in low-temperature fixability and high-temperature storability by using a polyester resin as the resin for the shell layer.

However, when a styrene acrylic resin is used as the resin for the core particle and a polyester resin is used as the resin for the shell layer, high-temperature storability is insufficient since lack of affinity between the styrene acrylic resin and the polyester resin makes it difficult to form a thin and uniform shell layer. In addition, difficulty in controlling the shape of toner particles due to the unlikeliness of fusion between the core particle and shell layer makes it difficult to form a shell layer with uniform surface and thus to form toner particles having a dense and smooth surface, resulting in the shell layer to come off due to its inferior fracture resistance by the stirring of the toner in a developing device during continuous printing. As a consequence, the electric charge amount greatly varies and hence unwanted noise occurs in the resultant image resulting in low image quality.

In order to solve these problems, for example, Japanese Patent Application Laid-Open No. 2013-109246 discloses a toner having a core-shell structure that includes an acrylic-modified polyester resin as the resin for the shell layer. The use of acrylic modified polyester resin as the resin for the shell layer improves its affinity for the styrene acrylic resin constituting the core particle, and thus it becomes possible to form a shell layer having a surface with a certain degree of uniformity.

However, since the release agent (wax) has high hydrophobicity, it is likely that migration of the release agent is blocked by the shell layer during heat fixing and therefore the release agent fails to exude as far as to the surface of the fixed image and as a result sufficient separability is not achieved.

SUMMARY OF THE INVENTION

The present invention has been achieved in light of the above-described circumstances pertinent in the art, and at least an object of the present invention is to provide a toner for developing an electrostatic latent image, and a process for producing the same, the toner being capable of achieving low-temperature fixability, high-temperature storability, and separability.

The present invention provides, as means for achieving the above-mentioned object, a toner for developing an electrostatic latent image, including toner particles including a binder resin, a colorant, and a release agent, the binding resin including a vinyl resin and a non-crystalline polyester resin, wherein, the toner particles include a matrix phase composed of a vinyl resin, and domain phases composed of a non-crystalline polyester resin dispersed in the matrix phase, a number-average domain diameter of the domain phases composed of the non-crystalline polyester resin is 30 to 150 nm, and the toner satisfies the following Requirement (1):

$$a/(a+b)\times 100(\%)>80(\%) \qquad \text{Requirement (1):}$$

where when "r" is defined as an average radius of a cross-section, having a maximum area, of the toner particle, "a" represents a total area, in the cross-section, of the domain phases composed of the non-crystalline polyester resin present in a surface layer area having a distance of r/5 inwardly in a radial direction from a surface of the toner particle, and "b" represents a total area, in the cross-section, of the domain phases composed of the non-crystalline polyester resin present in areas other than the surface layer area.

In the above-mentioned toner, the binder resin preferably contains a crystalline polyester resin.

The process for producing the above-mentioned toner includes:

(1) producing resin microparticles having a vinyl polymer containing a release agent;

(2) adding a vinyl monomer to an aqueous medium in which non-crystalline polyester resin microparticles having a volume-based median diameter of 30 to 150 nm are dispersed, and conducing seed polymerization with the vinyl monomer using the non-crystalline polyester resin microparticles as seed particles to produce seed polymerization resin microparticles having a volume-based median diameter of 40 to 160 nm in which the non-crystalline polyester resin microparticles are coated with the vinyl polymer;

(3) aggregating the resin microparticles with colorant microparticles in an aqueous medium to produce core particles; and (4) aggregating and fusing the seed polymerization resin microparticles on a surface of the core particles to form a shell layer, in which a volume-based median diameter of toner particles constituting the toner is 3 to 8 μm.

According to the above-mentioned toner, it becomes possible to achieve low-temperature fixability, high-temperature storability and separability, since small-sized domain phases each composed of a non-crystalline polyester resin are dispersed in a matrix phase composed of a vinyl resin so as to be localized in the surface layer area of the toner particle.

According to the process for producing the above-mentioned toner, it becomes possible to easily produce a toner capable of achieving low-temperature fixability, high-temperature storability and separability, with its surface being smoothed.

BRIEF DESCRIPTION OF THE DRAWINGS

FIG. 1 is a schematic diagram illustrating a structure of a cross-section of a toner particle according to the present invention.

DESCRIPTION OF THE PREFERRED EMBODIMENTS

Hereinafter, the present invention will be described specifically.

A toner according to an embodiment of the present invention includes toner particles containing a binder resin having a vinyl resin and a non-crystalline polyester resin; a colorant; and a release agent. As illustrated in FIG. 1, the toner particle has a sea-island structure in which domain phases 12 each composed of a non-crystalline polyester resin are dispersed in a matrix phase composed of a vinyl resin.

As used herein, sea (matrix phase) in the sea-island structure refers to a continuous phase, whereas island (domain phase 12) refers to a non-continuous phase (dispersed phase) surrounded by the sea (matrix phase). As used herein, the term "matrix phase composed of a vinyl resin" means a matrix phase which is substantially composed of a vinyl resin and may contain other toner material(s) to such an extent that the matrix phase is constituted. As used herein, the term "domain phase composed of a non-crystalline polyester resin" means a domain phase which is substantially composed of a non-crystalline polyester resin and may include other toner material(s) to such an extent that the domain phase is constituted.

Whether or not such a sea-island structure is formed in a toner particle can be confirmed by observing a cross-section of the toner particle using a scanning transmission electron microscope, as described below.

<Method of Observing Cross-Section of Toner Particles>

(1. Outline)

Instrument: scanning transmission electron microscope "JSM-7401F" (manufactured by JEOL, Ltd.)

Specimen: section of a toner particle dyed with ruthenium tetraoxide (Ru04) (thickness of the section: 100 to 200 nm)

Acceleration voltage: 30 kV

Magnification: ×10,000, bright field image (2. Method of Producing Section of Toner Particle)

Toner is dispersed in photo-curable resin "D-800" (manufactured by JEOL, Ltd.) and is photo-cured to form a block. Subsequently, a thin piece of sample of 100 to 200 nm thickness is cut out from the block using a microtome equipped with diamond teeth, and the sample is placed on a grid with a supporting film for transmittance electron microscopy. A filter paper is laid on a 5-cm diameter plastic petri dish, and the grid having the section placed thereon is placed on the petri dish with the section-placed side up.

Dyeing conditions (time, temperature, concentration and amount of dyeing agent) are adjusted so as to enable different resins to be distinguished from each other upon transmittance electron microscopy. For example, a few drops of 0.5% RuO4 dyeing liquid are placed at 2 points on the petri dish, and the dish is capped. 10 minutes later, the petri dish was uncapped, and left to stand until the moisture content of the dyeing liquid was removed.

(3. Method of Distinguishing Resins in Observation Image)

Resins inside toner particles in the observation image are distinguished from each other according to the following standards:

Observed as a dark area: vinyl resin

Observed as a bright area: non-crystalline polyester resin

Observed as a bright area with dark boundaries: release agent

The number-average domain diameter of domain phases 12 composed of the non-crystalline polyester resin is 30 to 150 nm, and preferably 60 to 100 nm.

When the number-average domain diameter of domain phases 12 composed of a non-crystalline polyester resin is 30 nm or more, it is possible to easily control the aggregation of seed polymerization resin microparticles (S) during toner production. On the other hand, when the number-average domain diameter of domain phases 12 composed of a non-crystalline polyester resin is 150 nm or less, the release agent is not prevented from exuding to the surface of the fixed image during heat fixing and therefore it is possible to sufficiently secure separability. It is noted that the smaller the domain diameter of the domain phase composed of a non-crystalline polyester resin in a toner particle, the more paths for the fused release agent are formed that allow the fused release agent to pass through the surface layer area to the surface of the toner particle during heat fixing, i.e., paths formed by the vinyl resin near the surface of the toner particle, thus making it easier for the release agent to exude to the surface of the toner particle.

In addition, when the number-average domain diameter of domain phases 12 composed of a non-crystalline polyester resin falls within the above-mentioned range, i.e., smaller diameter range, the surface of toner particles can be smoothed with less amount of heat during toner production.

<Method of Measuring Number-Average Domain Diameter of Domain Phases Composed of Non-Crystalline Polyester Resin>

The number-average domain diameter of domain phases 12 composed of a non-crystalline polyester resin is measured using the above-described method that involves observation of cross-sections of toner particles. That is, first, 25 toner particle images in which a cross-section of a toner particle having a maximum area (hereinafter, also referred to as "maximum cross-section") is observed are arbitrarily selected and analyzed using image processing analyzer "LUZEX (registered trademark) AP" (manufactured by Nireco Corporation). Then, 200 domain phases composed of non-crystalline polyester resin in the 25 toner particle images having the maximum cross-section are arbitrarily selected, and the Feret's diameters thereof in the horizontal direction are measured followed by calculation of their arithmetic average value. In this way, the number-average domain diameter of domain phases 12 composed of a non-crystalline polyester resin is obtained.

The Feret's diameter in the horizontal direction of the domain phase composed of a non-crystalline polyester resin refers to the length of a side of a circumscribed rectangle which is parallel to the x-axis, when the domain phase image is subjected to binarization processing.

The toner particle image having a maximum cross-section means a toner particle image whose average diameter of toner particle is within ±10% of the volume-based median diameter ($D_{50}$) as measured by the below-described method of measuring the average particle diameter of toner. In order to select 25 toner particle images arbitrarily, it may also be possible to observe the cross-sections of the toner particles for multiple visual fields, as necessary.

The average diameter of a toner particle image is a value calculated by the average value of the longest diameter "s" and the shortest diameter "t" of the toner particle image: (s+t)/2.

The toner of the present embodiment satisfies the following Requirement (1):

$$a/(a+b)\times 100(\%)>80(\%) \qquad \text{Requirement (1):}$$

where when "r" is defined as an average radius of a maximum cross-section of the toner particle, "a" represents a total area, in the maximum cross-section, of the domain phases composed 12 of the non-crystalline polyester resin present in surface layer area 11 having a distance of r/5 inwardly in a radial direction from a surface of the toner particle, and "b" represents a total area, in the maximum cross-section, of domain phases 12 composed of the non-crystalline polyester resin present in areas other than the surface layer area 11 (hereinafter, also referred to as the "inner area").

As used herein, "a/(a+b)×100" in the above Requirement (1) means the ratio of domain phases 12 composed of a non-crystalline polyester resin localized in surface layer area 11 (hereinafter, also referred to as "ratio of domain phases localized in the surface layer area") in the toner particle.

When the ratio of domain phases localized in the surface layer area is 80% or more, it is possible to obtain excellent high-temperature storability.

The ratio of domain phases localized in the surface layer area is preferably 90% or more.

The ratio of domain phases localized in the surface layer area can be adjusted by changing the timing of addition of microparticles of non-crystalline polyester resin for domain phases 12, when forming a shell layer on core particles grown to have a particle diameter smaller than a target particle diameter.

The total areas of "a" and "b", in the maximum cross-section, of domain phases 12 composed of the non-crystalline polyester resin present in each of surface layer area 11 and inner area 13 are measured using the above-mentioned method of observing a cross-section of the toner particles. That is, first, 5 toner particle images in which a maximum cross-section of a toner particle is observed are arbitrarily selected and analyzed using image processing analyzer "LUZEX (registered trademark) AP" (manufactured by Nireco Corporation). For all domain phases 12 composed of the non-crystalline polyester resin having the number-average domain diameter within a range of 30 to 150 nm in the above-mentioned 5 toner particle images having the maximum cross-section, the total area of domain phase 12 present in surface layer area 11 and the total area of domain phases 12 present in inner area 13 are calculated, to measure the total areas "a" and "b", in the maximum cross-section, of domain phases 12 composed of the non-crystalline polyester resin present respectively in surface layer area 11 and inner area 13.

The average radius "r" of the maximum cross-section of the toner particle is an arithmetic average of the half values of the average diameters for 5 toner particle images selected as described above, the average diameter being calculated from the equation (s+t)/2 where "s" is the longest diameter and "t" is the shortest diameter of each of the toner particle images.

[Binder Resin]

The binder resin is composed of at least a vinyl resin and a non-crystalline polyester resin. Vinyl resin is a resin exhibiting high viscoelasticity at elevated temperature, and contributes to the enhancement of separability and hot offset resistance. On the other hand, the non-crystalline polyester resin is a resin having an excellent sharp-melting property while maintaining higher glass transition point (Tg) than the vinyl resin, and can exert excellent effects not only in high-temperature storability and separability due to the high glass transition point, but also in low-temperature fixability due to the sharp melt property.

In the present invention, it is sufficient for the binder resin to contain a vinyl resin and a non-crystalline polyester resin; other resins may be contained in such a range as not to exceed the content ratio of the vinyl resin. A crystalline polyester resin is preferably contained as other resins.

[Vinyl Resin]

The vinyl resin constituting the binder resin is formed using a monomer having a vinyl resin (hereinafter, referred to as "vinyl monomer"); the vinyl resin can be composed of, specifically, a styrene acrylic copolymer, a styrene polymer, an acrylic polymer, or the like, with a vinyl resin composed of a styrene acrylic copolymer being preferred.

Hereinafter, vinyl monomers that can be used for the formation of the vinyl resin are shown.

The vinyl monomers to be exemplified hereinafter can be used singly or in combination.

Examples of the vinyl monomers include styrene monomers such as styrene, o-methylstyrene, m-methylstyrene, p-methylstyrene, p-methoxystyrene, p-phenylstyrene, p-chlorostyrene, p-ethylstyrene, p-n-butylstyrene, p-tert-butylstyrene, p-n-hexylstyrene, p-n-octylstyrene, p-n-nonylstyrene, p-n-decylstyrene, p-n-dodecylstyrene, 2,4-dimethylstyrene, and 3,4-dichlorostyrene; and (meth)acrylic acid ester monomers such as methyl acrylate, ethyl acrylate, propyl acrylate, butyl acrylate, 2-ethylhexyl acrylate, hexyl acrylate, cyclohexyl acrylate, heptyl acrylate, phenyl acrylate, methyl methacrylate, ethyl methacrylate, propyl methacrylate, butyl methacrylate, hexyl methacrylate, cyclohexyl methacrylate, 2-ethylhexyl methacrylate, heptyl methacrylate, β-hydroxyethyl acrylate, γ-aminopropyl acrylate, stearyl methacrylate, dimethylaminoethyl methacrylate, and diethylaminoethyl methacrylate.

In addition, as the vinyl monomer, the following compounds can also be used.

Vinyl Esters such as vinyl propionate, vinyl acetate, and vinyl benzoate.

Vinyl Ethers such as vinyl methylether, and vinyl ethylether.

Vinyl Ketones such as vinyl methylketone, vinyl ethylketone, and vinyl hexylketone.

N-Vinyl Compounds such as N-vinyl carbazole, N-vinyl indole, and N-vinyl pyrrolidone.

Other Compounds such as vinyl compounds including vinyl naphthalene, and vinyl pyridine; and acrylic acid or methacrylic acid derivatives including acrylonitrile, methacrylonitrile, and acrylamide.

In addition, as the vinyl monomer, a polymerizable monomer having an acid group can be used. The polymerizable monomer having an acid group means, for example, a monomer having an ionic leaving group such as a carboxyl group, a sulfonic group, or a phosphate group. Specifically, there are the following monomers.

Examples of the monomer having a carboxy group include acrylic acid, methacrylic acid, maleic acid, itaconic acid, cinnamic acid, fumaric acid, maleic acid monoalkyl ester, and itaconic acid monoalkyl ester. In addition, examples of the monomer having a sulfonic group include styrene sulfonate, allylsulfosuccinate, and 2-acrylamide-2-methyl propanesulfonate. Further, examples of the monomer having a phosphate group include acid phosphoxy ethyl methacrylate.

Further, it is also possible to use polyfunctional vinyls as the vinyl monomer and to allow the vinyl resin to have a cross-linking structure. Examples of the polyfunctional vinyls include divinyl benzene, ethylene glycol dimethacrylate, ethylene glycol diacrylate, diethylene glycol dimethacrylate, diethylene glycol diacrylate, triethylene glycol dimethacrylate, tirethylene glycol diacrylate, neopentyl glycol dimethacrylate, and neopentyl glycol diacrylate.

When using the polyfunctional vinyls, the copolymerization ratio thereof to the total of the vinyl monomers is typically 0.001 to 5% by mass, preferably 0.003 to 2% by mass, and more preferably 0.01 to 1% by mass. The use of the polyfunctional vinyls generates a gel component insoluble in tetrahydrofuran; the ratio of the gel component to the total of the polymer is typically 40% by mass or less, and preferably 20% by mass or less.

[Molecular Weight of Vinyl Resin]

The weight-average molecular weight (Mw) of the vinyl resin calculated from the molecular weight distribution measured by gel permeation chromatography (GPC) is preferably 20,000 to 60,000.

The weight-average molecular weight (Mw) of the vinyl resin being 20,000 or more allows sufficient high-temperature storability to be achieved. In addition, the weight-average molecular weight (Mw) of the vinyl resin being 60,000 or less allows sufficient low-temperature fixability to be achieved.

The measurement of the molecular weight distribution of the vinyl resin using GPC is conducted as follows. That is, an apparatus "HLC-8220" (manufactured by Tosoh Corporation) and a column "TSK guard column+TSK gel Super HZM-M 3 series" (manufactured by Tosoh Corporation) are used. Tetrahydrofuran (THF) is flowed as a carrier solvent at a flow rate of 0.2 ml/min while maintaining the column temperature at 40° C., and a measurement sample (vinyl resin) is dissolved into tetrahydrofuran in a dissolving condition of conducting a 5-minute treatment using an ultrasonic disperser at room temperature so as to have a concentration of 1 mg/ml. Subsequently, treatment with a membrane filter having a pore size of 0.2 μm gives a sample solution. 10 μL of the sample solution is then injected into the apparatus together with the above carrier solvent, and a refractive index detector (RI detector) is used for detection to calculate the molecular weight distribution of the measurement sample using a calibration curve measured using monodisperse polystyrene standard particles. As the standard polystyrene sample for measurement of the calibration curve, standard polystyrene samples (manufactured by Pressure Chemical Company) having molecular weights of $6\times10^2$, $2.1\times10^3$, $4\times10^3$, $1.75\times10^4$, $5.1\times10^4$, $1.1\times10^5$, $3.9\times10^5$, $8.6\times10^5$, $2\times10^6$, and $4.48\times10^6$ are used, and at least about 10 standard polystyrene samples are measured to prepare a calibration curve using a refractive index detector as the detector.

[Glass Transition Point of Vinyl Resin]

The glass transition point of the vinyl resin is preferably 35 to 65° C., and more preferably 40 to 60° C.

The glass transition point of the vinyl resin being 35° C. or higher allows sufficient high-temperature storability to be achieved. On the other hand, the glass transition point of the vinyl resin being 65° C. or lower allows sufficient low-temperature fixability to be achieved.

The glass transition point (Tg) of the vinyl resin is a value measured using "Diamond DSC (manufactured by PerkinElmer Co., Ltd.)."

In this measuring procedure, 3.0 mg of the measurement sample (vinyl resin) is sealed in an aluminum-made pan, which is then placed in a holder. As a reference, an empty aluminum-made pan is used. Under the measuring conditions of a measurement temperature of 0 to 200°, an elevating rate of 10° C./min, and a cooling rate of 10° C./min, Heat-Cool-Heat temperature control is conducted, and analysis is conducted based on the data of the second Heat. The intersection between an extension line from the baseline before the rising part of a first endothermic peak and a tangent indicating the maximum inclination drawn from the rising part of the first peak to the peak apex is set as the glass transition point.

The content ratio of the vinyl resin in the binder resin is preferably 65 to 95% by mass.

[Non-Crystalline Polyester Resin]

The non-crystalline polyester resin is obtained by condensation polymerization of at least a polyvalent alcohol component and a polyvalent carboxylic acid component, and is a polyester resin that exhibits no distinct endothermic peak observed in Differential Scanning calorimetry (DSC).

In the present invention, the non-crystalline polyester resin may be a vinyl-modified non-crystalline polyester resin in which a vinyl polymerization segment and a non-crystalline polyester polymerization segment are bonded.

As the polyvalent carboxylic acid component for forming the non-crystalline polyester resin, a polyvalent carboxylic acid, and an alkyl ester, an acid anhydride or an acid chloride thereof can be used. As the polyvalent alcohol component, a polyvalent alcohol and an ester compound thereof, and a hydroxy carboxylic acid can be used.

Examples of the polyvalent carboxylic acid include aromatic carboxylic acids such as terephthalic acid, isophthalic acid, phthalic anhydride, trimellitic anhydride, pyromellitic acid, naphthalene dicarboxylic acid, naphthalene tricarboxylic acid, and naphthalene tetracarboxylic acid; aliphatic carboxylic acids such as maleic anhydride, fumaric acid, succinic acid, alkenyl succinic anhydride, and adipic acid; and alicyclic carboxylic acids such as cyclohexane dicarboxylic acid. Among those polyvalent carboxylic acids, a polyvalent carboxylic acid not containing a straight chain alkyl group is preferably used, and an aromatic carboxylic acid is more preferably used. Further, for the purpose of securing satisfactory fixability by forming a cross-linking structure or a branched structure, it is preferable to use a trivalent or higher-valent carboxylic acid (such as trimellitic acid, or other acid anhydrides) together with the dicarboxylic acid.

The polyvalent carboxylic acid component is not limited to a single type, and a mixture thereof may also be used.

Examples of the polyvalent alcohol include aliphatic diols such as ethylene glycol, diethylene glycol, triethylene glycol, propylene glycol, butanediol, hexanediol, octanediol, decanediol, dodecanediol, and neopentyl glycol; alicyclic diols such as cyclohexanediol, and cyclohexane dimethanol; and aromatic diols such as an ethylene oxide adduct of bisphenol A, and a propylene oxide adduct of bisphenol A. Among these polyvalent alcohols, a polyvalent alcohol not containing a straight chain alkyl group is preferably used; aromatic diols or alicyclic diols are more preferably used; and aromatic diols are even more preferably used. Further, for the purpose of securing satisfactory fixability by forming a cross-linking structure or a branched structure, it is preferable to use a trivalent or higher-valent alcohol (such as glycerol, trimethylol propane, pentaerythritol, hexamethylolmelamine, hexaethylolmelamine, tetramethylolbenzoguanamine or tetraethylolbenzoguanamine) together with the diol.

The polyvalent alcohol component is not limited to a single type, and a mixture thereof may also be used.

The process for producing the non-crystalline polyester resin is not limited, and the non-crystalline polyester resin can be produced using a common method for polymerizing a polyester in which a polyvalent carboxylic acid component and a polyvalent alcohol component are reacted in the presence of a catalyst. For example, it is preferable to use direct polycondensation and ester exchange method appropriately depending on the type of monomers for the production of the non-crystalline polyester resin.

The temperature for polymerization can be set between 180 and 230° C., with the pressure inside the reaction system being reduced as necessary, so that the reaction is allowed to proceed while removing water or an alcohol generated during condensation.

When a monomer is not dissolved or compatible at a reaction temperature, a solvent having a high boiling point may be added as a solubilizing agent for dissolving the monomer. The polycondensation reaction is conducted while distilling off the solubilizing solvent. When there is a monomer with low compatibility in the copolymerization reaction, it is better to allow the monomer with low compatibility and an acid or alcohol to be subjected to polycondensation with this monomer to undergo condensation in advance, before being subjected to the polycondensation together with the main component.

Examples of the catalyst that can be used for the production of the non-crystalline polyester resin include compounds of alkali metals such as sodium, and lithium; compounds of alkali earth metals such as magnesium, and calcium; compounds of metals such as zinc, manganese, antimony, titanium, tin, zirconium, and germanium; phosphite compounds; phosphate compounds; and amine compounds.

Specific examples of the catalyst include sodium acetate, sodium carbonate, lithium acetate, lithium carbonate, calcium acetate, calcium stearate, magnesium acetate, zinc acetate, zinc stearate, zinc naphthenate, zinc chloride, manganese acetate, manganese naphthenate, titanium tetraethoxide, titanium tetrapropoxide, titanium tetraisopropoxide, titanium tetrabutoxide, antimony trioxide, triphenylantimony, tributylantimony, tin formate, tin oxalate, tetraphenyl tin, dibutyl tin dichloride, dibutyl tin oxide, diphenyl tin oxide, zirconium tetrabutoxide, zirconium naphthenate, zirconyl carbonate, zirconyl acetate, zirconyl stearate, zirconyl octylate, germanium oxide, triphenyl phosphite, tris(2,4-di-t-butylphenyl)phosphite, ethyl triphenyl phosphonium bromide, triethylamine, and triphenylamine.

As for the usage ratio between the above-mentioned polyvalent carboxylic acid component and polyvalent alcohol component, the equivalent ratio of a hydroxyl group [OH] of the polyvalent alcohol component to a carboxyl group [COOH] of the polyvalent carboxylic acid component ([OH]/[COOH]) is preferably 1.5/1 to 1/1.5, and more preferably 1.2/1 to 1/1.2.

As for the molecular weight of the non-crystalline polyester resin measured by gel permeation chromatography (GPC), the weight-average molecular weight (Mw) is preferably 1,500 to 60,000, and more preferably 3,000 to 40,000.

The weight-average molecular weight (Mw) of the non-crystalline polyester resin being 1,500 or more allows the entire binder resin to obtain suitable aggregation force, and suppresses the occurrence of hot offset phenomenon during heat fixing. The weight-average molecular weight (Mw) of the non-crystalline polyester resin being 60,000 or less enables sufficient low melt viscosity to be obtained and sufficient minimum fixing temperature to be secured, thereby suppressing the occurrence of the hot offset phenomenon during heat fixing.

The measurement of the molecular weight of the non-crystalline polyester resin by GPC is conducted in the same manner as described above except that the non-crystalline polyester resin is used as a measurement sample.

The glass transition point of the non-crystalline polyester resin is preferably 42 to 75° C., and more preferably 45 to 70° C.

The glass transition point of the non-crystalline polyester resin being 42° C. or higher allows the non-crystalline polyester resin to have proper aggregation force at an elevated temperature range, and suppresses the occurrence of the hot offset phenomenon during heat fixing. In addition, the glass transition point of the non-crystalline polyester resin being 75° C. or lower enables sufficient melting to be obtained during heat fixing, leading to sufficient low-temperature fixability.

The glass transition point of the non-crystalline polyester resin is measured in the same manner as described above except that the non-crystalline polyester resin is used as a measurement sample.

(Vinyl-Modified Non-Crystalline Polyester Resin)

The vinyl-modified non-crystalline polyester resin is a resin in which a vinyl polymerization segment and a non-crystalline polyester segment are bonded.

(Vinyl Segment)

The vinyl polymerization segment is formed from a vinyl monomer. Specifically, the vinyl polymerization segment can be formed of a styrene acrylic copolymer, a styrene polymer, an acrylic polymer, or the like, with a vinyl polymerization segment formed of a styrene acrylic copolymer being preferred.

As the vinyl monomer that can be used for forming the vinyl polymerization segment, it is possible to use the vinyl monomer exemplified as the vinyl monomer that can be used for forming a vinyl resin.

The vinyl monomers for forming the vinyl polymerization segment can be used singly or in combination.

(Non-Crystalline Polyester Polymerization Segment)

The non-crystalline polyester segment can have a similar configuration to that of the above-mentioned non-crystalline polyester resin.

The content ratio of the vinyl polymerization segment in the vinyl-modified non-crystalline polyester resin is preferably 5 to 30% by mass, and more preferably 7 to 20% by mass.

Specifically, the content ratio of the vinyl polymerization segment is a ratio of the mass of the vinyl monomers, to the total mass of the resin material to be used for synthesizing the vinyl-modified non-crystalline polyester resin, i.e., the total mass of the polyvalent carboxylic acid and the polyvalent alcohol to constitute the non-crystalline polyester polymerization segment, the vinyl monomers to constitute the vinyl polymerization segment, and a bireactive monomer for bonding these components.

The content ratio of the vinyl polymerization segment being within the above-mentioned range allows the affinity with respect to the vinyl resin constituting the matrix phase to be properly controlled, thereby enabling the surface smoothness of toner particles to be secured.

(Process for Producing Vinyl-Modified Non-Crystalline Polyester Resin)

The vinyl-modified non-crystalline polyester resin can be produced by bonding the non-crystalline polyester polymerization segment and the vinyl polymerization segment via a bireactive monomer. To be more specific, the vinyl-modified non-crystalline polyester resin can be produced by conducting condensation polymerization reaction, with a polyvalent carboxylic acid and a polyvalent alcohol being present at at least one point in time of before, during and after the step of addition polymerization of the vinyl monomer.

Specifically, an existing common scheme can be used. Examples of the typical process include the following three processes:

(1) A process in which an addition polymerization reaction of vinyl monomers for forming a vinyl polymerization segment is conducted, and then a polyvalent carboxylic acid and a polyvalent alcohol are subjected to a condensation polymerization reaction for forming a non-crystalline polyester polymerization segment, with a trivalent or higher-valent vinyl monomer to be a cross-linking agent being added to the reaction system as necessary, to allow the condensation polymerization reaction to further proceed;

(2) A process in which a polyvalent carboxylic acid and a polyvalent alcohol are subjected to a condensation polymerization reaction for forming a non-crystalline polyester polymerization segment, and then an addition polymerization reaction of vinyl monomers for forming a vinyl polymerization segment is conducted, followed by addition of a trivalent or higher-valent vinyl monomer to be a cross-linking agent to the reaction system as necessary, to allow the condensation polymerization reaction to further proceed under a temperature condition suitable for the condensation polymerization reaction; and (3) A process in which, under a temperature condition suitable for an addition polymerization reaction, an addition polymerization reaction of vinyl monomers for forming a vinyl polymerization segment is conducted in parallel with a condensation polymerization reaction of a polyvalent carboxylic acid and a polyvalent alcohol for forming a non-crystalline polyester polymerization segment, and, after completion of the addition polymerization reaction, a trivalent or higher-valent vinyl monomer to be a cross-linking agent is added to the reaction system as necessary, to allow the condensation polymerization reaction to further proceed under a temperature condition suitable for the condensation polymerization reaction.

The bireactive monomer is added together with the polyvalent carboxylic acid/polyvalent alcohol and/or the vinyl monomer.

The bireactive monomer is a compound having, in its molecule, at least one functional group selected from the group consisting of a hydroxyl group, a carboxy group, an epoxy group, a primary amino group and a secondary amino group, preferably a hydroxyl group and/or a carboxy group, and more preferably a carboxy group and an ethylenic unsaturated bond; that is, the bireactive monomer is preferably a vinyl carboxylic acid. Specific examples of the bireactive monomer include acrylic acid, methacrylic acid, fumaric acid, and maleic acid; the bireactive monomer may further be a hydroxyl alkyl (having 1 to 3 carbon atoms) ester thereof, with acrylic acid, methacrylic acid, and fumaric acid being preferred in terms of reactivity.

It is preferable to use, as the bireactive monomer, a monovalent vinyl carboxylic acid rather than a polyvalent vinyl carboxylic acid, from the viewpoint of toner durability. The reason for preferably using the monovalent vinyl carboxylic acid is because high reactivity between the monovalent vinyl carboxylic acid and the vinyl monomer is considered to easily lead to hybridization. On the other hand, when a dicarboxylic acid such as fumaric acid is used as the bireactive monomer, the toner durability is slightly deteriorated. The reason for this slight deterioration is because the difficulty in uniform hybridization due to the low reactivity between the dicarboxylic acid and the vinyl monomer is considered to result in a domain structure.

From the viewpoint of enhancing the low-temperature fixability, hot offset resistance and fragmentation resistance of the toner, the amount of the bireactive monomer to be used is preferably 1 to 10 parts by mass, and more preferably 4 to 8 parts by mass per 100 parts by mass of the total amount of the vinyl monomer; and is preferably 0.3 to 8 parts by mass, and more preferably 0.5 to 5 parts by mass per 100 parts by mass of the total amount of the polyvalent carboxylic acid and the polyvalent alcohol.

The addition polymerization reaction can be conducted, for example, in the presence of a radical polymerization initiator, a cross-linking agent, or the like, and in the presence of an organic solvent or in the absence of a solvent according to the common method; the temperature condition is preferably 110 to 200° C., and more preferably 140 to 180° C. Examples of the radical polymerization initiator include dialkyl peroxide, dibutyl peroxide, and butylperoxy- 2-ethylhexyl monocarboxylic acid, and the radical polymerization initiator can be used singly or in combination.

The condensation polymerization reaction can be conducted, for example, in an inert gas atmosphere and under the temperature condition of 180 to 250° C., and preferably in the presence of an esterification catalyst, a polymerization inhibitor, or the like. Examples of the esterification catalyst include tin(II) compounds not having a Sn—C bond such as dibutyl tin oxide, a titanium compound and tin octylate, and the esterification catalyst can be used singly or in combination.

The content ratio of the non-crystalline polyester resin in the binder resin is preferably 5 to 70% by mass, and more preferably 10 to 20% by mass.

The content ratio of the non-crystalline polyester resin being within the above-mentioned range allows the non-crystalline polyester resin to sufficiently exert resin characteristics, thus enabling excellent low-temperature fixability, high-temperature storability and separability to be achieved.

[Crystalline Polyester Resin]

In the present invention, the binder resin may contain the crystalline polyester resin. The crystalline polyester resin contributes to the low-temperature fixability as a fixation auxiliary.

The crystalline polyester resin is preferably dispersed as domain phases 14 (see FIG. 1) in inner area 13 of a toner particle.

The crystalline polyester resin is obtained by condensation polymerization of at least a diol component and a dicarboxylic acid component, and is a polyester resin not having a stepwise variation in endothermic energy amount, but having a distinct endothermic peak (having a shape in which an endothermic spectrum curve reaches the maximum point through an inflection point and descends to an inflection point) in the differential scanning calorimetry (DSC). The distinct endothermic peak specifically means a peak at which the half-value width of the endothermic peak is within 15° C. when measured at an elevating rate of 10° C./min, in the differential scanning calorimetry (DSC).

In the present invention, the crystalline polyester resin may be a vinyl-modified crystalline polyester resin in which the vinyl polymerization segment and the crystalline polyester polymerization segment are bonded.

Examples of the diol component for forming the crystalline polyester resin include, but not limited to, ethylene glycol, 1,3-propanediol, 1,4-butanediol, 1,5-pentanediol, 1,6-hexanediol, 1,7-heptanediol, 1,8-octanediol, 1,9-nonanediol, 1,10-decanediol, 1,11-dodecanediol, 1,12-undecanediol, 1,13-tridecanediol, 1,14-tetradecanediol, 1,18-octadecanediol, and 1,20-eicosanediol. Among those diol components, 1,9-nonanediol and 1,10-decanediol are preferably used, in terms of melting point, or the like.

The diol component is not limited to a single type, and a mixture thereof may also be used.

Examples of the dicarboxylic acid component for forming the crystalline polyester resin include aliphatic dicarboxylic acids such as oxalic acid, malonic acid, succinic acid, glutaric acid, adipic acid, pimelic acid, suberic acid, azelaic acid, sebacic acid, 1,9-nonanedicarboxylic acid, 1,10-decanedicarboxylic acid, 1,11-undecanedicarboxylic acid, 1,12-dodecanedicarboxylic acid, 1,13-tridecanedicarboxylic acid, 1,14-tetradecanedicarboxylic acid, 1,16-hexadecanedicarboxylic acid and 1,18-octadecanedicarboxylic acid, and lower alkyl esters and acid anhydrides thereof.

In addition, it is also possible to use, for example, aromatic dicarboxylic acids such as terephthalic acid, isophthalic acid, 2,6-naphthalenedicarboxylic acid and 4,4-biphenyldicarboxylic acid. Among those aromatic dicarboxylic acids, terephthalic acid is preferably used, from the viewpoint of easily forming a polyester resin having a low melting point.

A dicarboxylic acid component having a double bond or a dicarboxylic acid component having a sulfonic acid group may also be used.

The dicarboxylic acid component is not limited to a single type, and a mixture thereof may also be used.

The crystalline polyester resin can be produced according to a production process similar to the above-described process for the production of the non-crystalline polyester resin, although the process is not limited thereto.

As for the molecular weight of the crystalline polyester resin measured by gel permeation chromatography (GPC), the weight-average molecular weight (Mw) is preferably 8,000 to 35,000, and more preferably 10,000 to 30,000, in terms of the mechanical strength of the toner, the image strength of an obtained fixed image, productivity, and fixability.

The weight-average molecular weight (Mw) of the crystalline polyester resin being 8,000 or more allows sufficient offset resistance to be obtained during heat fixing. The weight-average molecular weight (Mw) of the crystalline polyester resin being 35,000 or less enables stable production of the crystalline polyester resin.

The measurement of the molecular weight of the crystalline polyester resin by GPC is conducted in the same manner as described above except that the crystalline polyester resin is used as a measurement sample.

The crystalline polyester resin having a melting point of 50 to 90° C. is preferably used, and the crystalline polyester resin having a melting point of 65 to 85° C. is more preferably used.

The crystalline polyester resin having a melting point of 50° C. or higher allows a toner to be obtained to have high thermal strength, thus enabling sufficient high-temperature storability to be achieved. In addition, the crystalline polyester resin having a melting point of 90° C. or lower enables sufficient low-temperature fixability to be achieved.

The melting point of the crystalline polyester resin is measured, specifically, using a differential scanning calorimeter "Diamond DSC" (manufactured by PerkinElmer Co., Ltd.) according to measuring conditions (temperature elevating/cooling conditions) which undergoes, sequentially, a first heating process in which the temperature of the crystalline polyester resin is elevated from 0 to 200° C. at an elevating rate of 10° C./min, a cooling process in which the temperature of the crystalline polyester resin is cooled from 200 to 0° C. at a cooling rate of 10° C./min, and a second heating process in which the temperature of the crystalline polyester resin is elevated from 0 to 200° C. at an elevating rate of 10° C./min. Based on the DSC curve obtained by this measurement, the endothermic peak top temperature derived from the crystalline polyester resin in the first heating process is set as the melting point. In this measuring procedure, 3.0 mg of crystalline polyester resin is sealed in an aluminum-made pan, which is then placed in a sample holder of the "Diamond DSC." As a reference, an empty aluminum-made pan is used.

(Vinyl-Modified Crystalline Polyester Resin)

The vinyl-modified crystalline polyester resin is similar to the above-mentioned vinyl-modified non-crystalline polyester resin except that a crystalline polyester polymerization segment is bonded in place of a non-crystalline polyester polymerization segment in the vinyl-modified non-crystalline polyester resin, and can be produced according to a production process similar to the above-described process for the production of the vinyl-modified non-crystalline polyester resin.

The crystalline polyester polymerization segment can have a similar configuration to that of the above-mentioned crystalline polyester resin.

The content ratio of the crystalline polyester resin in the binder resin is preferably 2 to 20% by mass, and more preferably 5 to 15% by mass.

The content ratio of the crystalline polyester resin being 2% by mass or more enables low-temperature fixability to be secured. In addition, the content ratio of the crystalline polyester resin being 20% by mass or less enables sufficient high-temperature storability to be achieved.

The molecular weight distribution, glass transition point and melting point of each of the resins constituting the binder resin can be measured, using a vinyl resin, a non-crystalline polyester resin and a crystalline polyester resin, extracted from toner particles, as measurement samples.

[Release Agent]

In the toner particle according to the present invention, the release agent is preferably dispersed as domain phases in the matrix phase having a vinyl resin, and further is more preferably present as domain phases independent of domain phases 12 composed of a non-crystalline polyester resin; particularly, domain phases composed of the release agent are preferably dispersed in inner area 13 of the toner particle. In the present invention, the "domain phase composed of the release agent" is substantially composed of the release agent, and may contain other toner materials in such a range as to constitute the domain phase.

The number-average domain diameter of the domain phases composed of the release agent is preferably 100 to 2,000 nm.

The number-average domain diameter of the domain phases composed of the release agent is measured in the same manner as the above-described method of measuring the number-average domain diameter of the domain phases composed of the non-crystalline polyester resin, except that the domain phase composed of the release agent, in place of the domain phase composed of the non-crystalline polyester resin, is measured in terms of Feret's diameter in the horizontal direction.

The release agent is not limited, and various known release agents can be used. Examples of the release agents include polyolefin waxes such as polyethylene wax and polypropylene wax; branched chain hydrocarbon waxes such as microcrystalline wax; long chain hydrocarbon waxes such as paraffin wax and Sasol wax; dialkyl ketone waxes such as distearyl ketone; ester waxes such as carnauba wax, montan wax, behenyl behenate, trimethylolpropane tribehenate, pentaerythritol tetrabehenate, pentaerythritol diacetate dibehenate, glyceryl tribehenate, 1,18-octadecanediol distearate, trimellitic acid tristearyl, and distearyl maleate; and amide waxes such as ethylenediamine behenylamide and trimellitic acid tristearylamide.

The content ratio of the release agent per 100 parts by mass of the binder resin is typically 2 to 20 parts by mass, preferably 3 to 18 parts by mass, and more preferably 4 to 15 parts by mass. The content ratio of the release agent being within the above-mentioned range enables sufficient separability to be achieved.

Among those release agents, a release agent having a lower melting point, specifically, a release agent having a melting point of 50 to 95° C. is preferably used, in terms of the releasability during low-temperature fixing.

[Colorant]

As the colorant, commonly known dyes and pigments can be used.

As colorants for obtaining black toners, it is possible to use any of known black colorants such as carbon blacks such as furnace black and channel black, magnetic materials such as magnetite and ferrite, dyes, and inorganic pigments including non-magnetic iron oxide.

As colorants for obtaining color toners, it is possible to use any of known color colorants such as dyes and organic pigments, and specific examples of the organic pigments include C.I. Pigment Red 5, 48:1, 53:1, 57:1, 81:4, 122, 139, 144, 149, 166, 177, 178, 222, 238, and 269; C.I. Pigment Yellow 14, 17, 74, 93, 94, 138, 155, 180, and 185; C.I. Pigment Orange 31, and 43; and C.I. Pigment Blue 15:3, 60, and 76. Examples of the dyes include C.I. Solvent Red 1, 49, 52, 58, 68, 11, and 122; C.I. Solvent Yellow 19, 44, 77, 79, 81, 82, 93, 98, 103, 104, 112, and 162; and C.I. Solvent Blue 25, 36, 69, 70, 93, and 95.

The colorants for a toner may be used singly or in combination for each color.

The content ratio of the colorant per 100 parts by mass of the binder resin is preferably 1 to 30 parts by mass, and more preferably 2 to 20 parts by mass.

[Configuration of Toner Particle]

A toner particle according to the present invention may contain an internal additive such as a charge control agent as necessary, other than the binder resin, the colorant and the release agent.

[Charge Control Agent]

As the charge control agent, various known compounds can be used.

The content ratio of the charge control agent per 100 parts by mass of the binder resin is typically 0.1 to 10 parts by mass, and preferably 0.5 to 5 parts by mass.

[Toner Softening Point]

The softening point of the toner of the present invention is preferably 90 to 120° C.

The softening point of the toner being within the above-mentioned range enables suitable low-temperature fixability to be achieved.

The softening point of the toner is measured using a flow tester as indicated below.

Specifically, 1.1 g of a sample (toner) is first fed into a petri dish and flattened, followed by being left to stand for 12 hours or longer in an environment of 20° C. and 50% RH, and then the sample is pressurized using a molding machine "SSP-10A" (manufactured by Shimadzu Corporation) for 30 seconds with a force of 3,820 kg/cm' to prepare a molded sample having a cylindrical shape with a diameter of 1 cm. Next, the molded sample is extruded from an aperture (1 mm diameter×1 mm) of a cylindrical die using a piston with a diameter of 1 cm from the time of the completion of preheating, under conditions of a load of 196 N (20 kgf), a starting temperature of 60° C., a preheating time of 300 seconds, and a temperature-elevating rate of 6° C./min using a flow tester "CFT-500D" (manufactured by Shimadzu Corporation) in an environment of 24° C. and 50% RH. An offset method temperature (Toffset) measured using melt temperature measuring method of the temperature-elevating method at an offset value of 5 mm is designated as the softening point.

[Average Particle Diameter of Toner]

The average particle diameter of the toner of the present embodiment, in terms of, for example, volume-based median diameter, is preferably 3 to 8 μm, and more preferably 4 to 8 μm. In the process for producing a toner to be described hereinafter, for example, the particle diameter can be controlled depending on the concentration of an aggregation agent, the fusing time of resin microparticles, the composition of a polymer constituting each resin, and the like.

The volume-based median diameter being within the above-mentioned range allows the transfer efficiency to be higher, thus allowing the quality of halftone images as well as the image quality of thin lines and dots to be enhanced.

The volume-based median diameter of the toner particle is measured and calculated using a measuring apparatus in which a computer system with data processing software "Software V3. 51" being installed therein is connected to "Multisizer 3" (manufactured by Beckman Coulter, Inc.). Specifically, 0.02 g of toner is added to 20 mL of a surfactant solution (e.g., a surfactant solution obtained by 10-fold dilution of a neutral detergent including a surfactant component with pure water, for the purpose of dispersing toner particles) and wetted, followed by ultrasonic dispersion for 1 minute to prepare a toner dispersion liquid, which toner dispersion liquid is injected into a beaker containing "ISOTON II" (manufactured by Beckman Coulter, Inc.) in a sample stand, with a pipette, until the concentration of the toner indicated by the measuring apparatus reaches 8%. Here, this concentration range makes it possible to give reproducible measurement values. Using the measuring apparatus, under conditions of the measured particle count number of 25,000 and an aperture diameter of 50 μm, the measurement range of 1 to 30 μm is divided into 256 parts, the frequency for each of the parts is calculated, and the particle size at which the cumulative volume percent passing from the larger particle-size side reaches 50% is determined as the volume-based median diameter.

[Average Circularity of Toner Particle]

The average circularity of each individual toner particle constituting the toner of the present embodiment is preferably 0.850 to 0.990, from the viewpoint of enhancing the transfer efficiency.

In the present invention, the average circularity of the toner particles is measured using "FPIA-2100" (manufactured by Sysmex Corporation).

Specifically, the sample (toner particles) is wetted with an aqueous solution containing a surfactant, and is dispersed via ultrasonic dispersion treatment for 1 minute, followed by photographing with "FPIA-2100" (manufactured by Sysmex Corporation) in an HPF (high magnification imaging) mode at an appropriate concentration of the HPF detection number of 3,000 to 10,000 as a measuring condition. The circularity of each individual toner particle is calculated according to the following Requirement (T), and the circularities of the respective toner particles are summed, which summed circularities are divided by the total number of the toner particles to calculate the average circularity of the toner particle.

Circularity=(circumference length of a circle having a projection area equal to that of a particle image)/(circumference length of the projection of the particle) Requirement (T):

According to the above-described toner, it becomes possible to achieve low-temperature fixability, high-temperature storability and separability, since small-sized domain phases each composed of a non-crystalline polyester resin are dispersed in a matrix phase composed of a vinyl resin so as to be localized in surface layer area 11 in the toner particle.

These effects are considered to be achieved for the following reasons. First, use of the non-crystalline polyester resin as the binder resin enables both low-temperature fixability and high-temperature storability to be achieved. Moreover, the non-crystalline polyester resin being dispersed as small-sized domain phases in surface layer area 11 of a toner particle allows the release agent to move among the domain phases during heat fixing, thereby allowing the release agent to exude sufficiently to the surface of a fixed image, thus enabling sufficient separability to be achieved.

[Process for Producing Toner]

The process for producing a toner of the present embodiment is a process for producing a toner composed of toner particles each having a binder resin containing a vinyl resin and a non-crystalline polyester resin, a colorant, and a release agent, the process including the steps of: aggregating resin microparticles (M) having a vinyl polymer (A) containing a release agent with colorant microparticles in an aqueous medium to produce core particles; adding to the surface of the core particles seed polymerization resin microparticles (S) in which non-crystalline polyester resin microparticles are coated with a vinyl polymer (B); and conducting aggregation and fusing to form a shell layer, thereby producing toner particles.

The toner particles obtained by the toner production process of the present embodiment have a so-called core-shell structure in which the surface of the core particle is covered with the shell layer. The shell layer preferably has a structure in which the core particle is entirely covered.

As used herein, the term "aqueous medium" means a medium composed of 50 to 100% by mass of water and 0 to 50% by mass of a water-soluble organic solvent. Examples of the water-soluble organic solvent include methanol, ethanol, isopropanol, butanol, acetone, methyl ethyl ketone, and tetrahydrofuran, and it is preferable to use an organic solvent that does not dissolve each of the resin microparticles.

A specific example of the process for producing a toner of the present embodiment is a production process including:

(1) producing resin microparticles (M) containing a release agent, in which resin microparticles (M) having a vinyl polymer (A) containing a release agent is produced;

(2) producing seed polymerization microparticles (S) containing non-crystalline polyester resin microparticles, in which vinyl monomers (b) is added into an aqueous medium having non-crystalline polyester resin microparticles being dispersed therein, and seed polymerization using the vinyl monomers (b) is conducted, employing the non-crystalline polyester resin microparticle as seed particles, to thereby produce resin microparticles (S) in which non-crystalline polyester resin microparticles are coated with a vinyl polymer (B);

(3) forming core particles, in which the resin microparticles (M) and colorant microparticles are aggregated in the aqueous medium to form core particles;

(4) a shell layer formation step in which the seed polymerization resin microparticles (S) are aggregated and fused on the surface of the core particles to thereby form shell layers, thus forming associated particles;

(5) an aging step in which the associated particles are aged by thermal energy to control the shape thereof, thus affording toner particles;

(6) a cooling step in which a dispersion liquid of toner particles is cooled;

(7) a filtration/washing step in which toner particles are filtered off from the aqueous medium to remove a surfactant or the like from the toner particles;

(8) a drying step in which the washed toner particles are dried; and (9) a step of adding an external additive, in which an external additive is added to the dried toner particles, in which the steps of (1) to (4) are essential, whereas the steps of (5) to (9) can be conducted as necessary, in the present invention.

(1) Process for Producing Resin Microparticles (M) Containing Release Agent

In this process, resin microparticles (M) containing a vinyl polymer (A) as a main component and containing a release agent is produced. An example of the process for producing the resin microparticles (M) can be a production process by mini-emulsion polymerization method using vinyl monomers (a) for obtaining the vinyl polymer (A). That is, for example, a monomer liquid mixture of vinyl monomers (a) with a release agent being dissolved or dispersed therein is added into an aqueous medium containing a surfactant, followed by application of mechanical energy to form a liquid droplet, and then a polymerization reaction is allowed to proceed in the liquid droplet using radicals from an water-soluble radical polymerization initiator. It is noted that the liquid droplet may contain an oil-soluble polymerization initiator. Thus, it becomes possible to produce the resin microparticles (M) containing a vinyl polymer (A) as a main component and a release agent.

The resin microparticles (M) preferably have an outermost layer formed only of the vinyl polymer (A). When the resin microparticles (M) have such a structure, there is no release agent present on the surface of the particles, and thus it becomes easy to allow the domain phase composed of the release agent to be present as a domain phase independently of domain phase 12 composed of a non-crystalline polyester resin inside a toner particle.

Such resin microparticles (M) having an outermost layer formed only of the vinyl polymer (A) can be produced, for example, by a method in which, in an aqueous medium in which release agent microparticles are dispersed, vinyl monomers (a) are allowed to undergo seed polymerization on the release agent microparticles, employing the release agent microparticles as seed particles, to form the outermost layer, or by a multistage polymerization method in which, by employing as seed particles the resin microparticles containing a release agent produced by the above-mentioned mini-emulsion polymerization method, vinyl monomers (a) are allowed to undergo seed polymerization on the resin microparticles containing the release agent to thereby form the outermost layer. In particular, the resin microparticles (M) are preferably produced by the multistage polymerization method, since it is possible to use a release agent with low melt viscosity in this method.

Examples of the vinyl monomers (a) for obtaining a vinyl polymer (A) include the vinyl monomer as mentioned above. The vinyl monomer below can be used singly or in combination as the vinyl monomer (a).

The content ratio of the release agent contained in the resin microparticles (M) is preferably 5 to 20% by mass. The content ratio of the release agent contained in the resin microparticles (M) being in the above-mentioned range allows both separability and low-temperature fixability to be securely achieved. Too small content ratio of the release agent may undesirably cause the occurrence of winding around the fixing member during heat fixing due to its lower separability, or may undesirably cause the occurrence of a hot offset phenomenon due to the attachment of the toner to the fixing member. Too large content ratio of the release agent may lower low-temperature fixability due to the increase in the amount of heat absorbed by the release agent or due to the inhibition of the adhesion between a recording material and the binder resin, or may undesirably cause the occurrence of filming in a photoconductor or an intermediate transfer member due to the generation of a free release agent.

(Surfactant)

As a surfactant, it is possible to use various conventionally known cationic surfactants, nonionic surfactants, anionic surfactants, and the like.

Specific examples of the cationic surfactants include dodecyl ammonium bromide, dodecyl trimethyl ammonium bromide, dodecyl pyridinium chloride, dodecyl pyridinium bromide, and hexadecyl trimethyl ammonium bromide.

Specific examples of the nonionic surfactants include dodecyl polyoxyethylene ether, hexadecyl polyoxyethylene ether, nonylphenyl polyoxyethylene ether, lauryl polyoxyethylene ether, sorbitan monooleate polyoxyethylene ether, styrylphenyl polyoxyethylene ether, and monodecanoyl saccharose.

Specific examples of the anionic surfactants include aliphatic soaps such as sodium stearate and sodium laurate, sodium lauryl sulfate, dodecyl benzene sodium sulfonate, and polyoxyethylene (2) lauryl ether sodium sulfate.

These surfactants can be used singly or in combination, as necessary.

(Polymerization Initiator)

As the polymerization initiator, various known polymerization initiators can be used. Specific examples of the polymerization initiator include oxides such as hydrogen peroxide, acetyl peroxide, cumyl peroxide, tert-butyl peroxide, propionyl peroxide, benzoyl peroxide, chloro benzoyl peroxide, dichloro benzoyl peroxide, bromomethyl benzoyl peroxide, lauroyl peroxide, ammonium persulfate, sodium persulfate, potassium persulfate, diisopropyl peroxy carbonate, tetralin hydroperoxide, 1-phenyl-2-methylpropyl-1-hydroperoxide, tert-hydroperoxide pertriphenylacetate, tert-butyl performate, tert-butyl peracetate, tert-butyl perbenzoate, tert-butyl perphenylacetate, tert-butyl permethoxyacetate, and tert-butyl per-N-(3-toluyl)palmitate; and azo compounds such as 2,2'-azobis-(2-aminodipropane) hydrochloride, 2,2'-azobis-(2-aminodipropane) nitrate, 1,1'-azobis-(1-methylbutyronitrile-3-sodium sulfonate), 4,4'-azobis-4-cyanovaleric acid, and poly(tetraethyleneglycol-2, 2'-azobisisobutyrate).

(Chain Transfer Agent)

In the present step, it is possible to use a generally-used chain transfer agent for the purpose of adjusting the molecular weight of the vinyl polymer (A). The chain transfer agent is not limited, and examples thereof include 2-chloroethanol, mercaptans such as octyl mercaptan, dodecyl mercaptan and t-dodecyl mercaptan, and a styrene dimer.

When other internal additives such as a charge control agent is contained in the toner particles according to the present invention, for example, it is possible to dissolve or disperse the internal additive in a monomer liquid mixture for forming the vinyl polymer (A) in advance, in this step of producing resin microparticles (M), to thereby introduce the internal additive into the toner particles.

In addition, such an internal additive can also be introduced into the toner particles by separately preparing a dispersion liquid of internal additive microparticles composed only of an internal additive, and allowing the internal additive microparticles together with the resin microparticles (M) and colorant resin microparticles in the core particle formation step; however, it is preferable to employ a method of introducing the internal additive in advance in the step of producing the resin microparticles (M).

The average particle diameter of the resin microparticles (M) is preferably within the range of 50 to 400 nm in terms of volume-based median diameter.

The volume-based median diameter of the resin microparticles (M) is measured using "Micro Track UPA-150" (manufactured by Nikkiso Co., Ltd.).

(2) Step of Producing Seed Polymerization Resin Microparticles (S) Containing Non-Crystalline Polyester Resin Microparticles In this step, seed polymerization resin microparticles (S) in which non-crystalline polyester resin microparticles are covered with a cover layer of the vinyl polymer (B). Specifically, vinyl monomers (b) and a polymerization initiator are added into an aqueous medium having non-crystalline polyester resin microparticles being dispersed therein, and seed polymerization using the vinyl monomers (b) is conducted, employing the non-crystalline polyester resin microparticle as seed particles, to thereby produce seed polymerization resin microparticles (S).

As the vinyl monomers (b), it is possible to use vinyl monomers exemplified as the above-mentioned vinyl monomers (a) for forming the vinyl polymer (A) constituting the resin microparticles (M) containing the release agent. The vinyl monomer can be used singly or in combination as the vinyl monomer (b).

In the present invention, it is preferable that the vinyl polymer (B) constituting the seed polymerization resin microparticles (S) and the vinyl polymer (A) constituting the outermost layer of the resin microparticles (M) are polymerized from the same type of monomers, and it is more preferable that the vinyl polymer (B) constituting the seed polymerization resin microparticles (S) and the vinyl polymer (A) constituting the outermost layer of the resin microparticles (M) have the same composition. However, the ratio of a monomer having a carbonyl group in the vinyl monomers (b) is preferably higher, in order to facilitate the orientation of the seed polymerization resin microparticles (S) for forming a shell layer on the surface. When, in this manner, the vinyl polymer (B) constituting the seed polymerization resin microparticles (S) and the vinyl polymer (A) constituting the outermost layer of the resin microparticles (M) have the same composition, and the ratio of the monomer having a carbonyl group in the vinyl monomers (b) is higher, it becomes possible to form a thin and uniform shell layer on the surface layer in the shell layer formation step.

In addition, it is preferable for the vinyl monomer (b) to contain at least a monomer having a carbonyl group. Examples of the preferred monomer having a carbonyl group include (meth)acrylic acid ester monomers and monomers having an acid group such as a carboxy group. Examples of the preferred (meth)acrylic acid ester monomers include methyl methacrylate, butyl acrylate, and 2-ethylhexyl acrylate. In addition, examples of the preferred monomers having a carboxy group include methacrylic acid and acrylic acid. Use of the monomer having a carbonyl group as the vinyl monomer (b) enables a cover layer of the vinyl polymer (B) to be easily formed on the surface of the non-crystalline polyester resin microparticle, since the monomer having a carbonyl group has higher polarity.

The ratio of the monomer having a carbonyl group to the total vinyl monomers (b) is preferably 2 to 15% by mass. Too large ratio of the monomer having a carbonyl group may undesirably cause toner blister or enlarge charge amount environmental difference due to the increase of the amount of adsorption of the moisture to the surface of toner particles.

The average particle diameter of the non-crystalline polyester resin microparticles constituting the seed particles is preferably within the range of 30 to 150 nm in terms of volume-based median diameter.

The volume-based median diameter of the non-crystalline polyester resin microparticles being within the above-mentioned range enables the number-average domain diameter of domain phases 12 composed of the non-crystalline polyester resin microparticles to be within the range of 30 to 150 nm in the toner particle to be obtained.

The volume-based median diameter of the non-crystalline polyester resin microparticles is measured using "Micro Track UPA-150" (manufactured by Nikkiso Co., Ltd.).

The addition amount of the vinyl monomer (b) to the non-crystalline polyester resin microparticles is set such that the content ratio of the non-crystalline polyester resin in the seed polymerization resin microparticles (S) to be obtained is preferably 5 to 90% by mass, and more preferably 25 to 75% by mass. The content ratio of the non-crystalline polyester resin in the seed polymerization resin microparticles (S) being 5% by mass or more enables excellent low-temperature fixability and high-temperature storability to be securely achieved. The content ratio of the non-crystalline polyester resin in the seed polymerization resin microparticles (S) being 90% by mass or less enables satisfactory surface smoothness of the toner particles to be achieved.

The aqueous medium may contain a surfactant. Examples of the surfactant include a surfactant similar to that as mentioned in the step of producing the above-mentioned resin microparticles (M) containing a release agent.

For the seed polymerization, it is possible to use a generally-used chain transfer agent for the purpose of adjusting the molecular weight of the vinyl polymer (B). Examples of the chain transfer agent include a chain transfer agent similar to that as mentioned in the step of producing the resin microparticles (M) containing a release agent.

Examples of the polymerization initiator include a polymerization initiator similar to that as mentioned in the step of producing the resin microparticles (M) containing a release agent.

The seed polymerization is preferably conducted in a condition where the viscosity of the non-crystalline polyester resin is higher. The polymerization temperature for the seed polymerization is preferably equal to or less than the melting point of the non-crystalline polyester resin+20° C., more preferably equal to or less than the melting point+10° C., and even more preferably equal to or less than the melting point.

The average particle diameter of the seed polymerization resin microparticles (S) is set within the range of 40 to 160 nm in terms of volume-based median diameter.

The volume-based median diameter of the seed polymerization resin microparticles (S) being within the above-mentioned range enables the surface of the toner particles to be densely coated to enable high-temperature storability to be secured.

The volume-based median diameter of the seed polymerization resin microparticles (S) is measured using "Micro Track UPA-150" (manufactured by Nikkiso Co., Ltd.).

(3) Step of Forming Core Particles

In this step, resin microparticles (M) and colorant microparticles, as well as microparticles of other toner constituent components as necessary, are aggregated. Specifically, these microparticles are aggregated by adding an aggregation agent having equal to or more than a critical aggregation concentration into the aqueous medium in which the microparticles are dispersed.

The colorant microparticles are preferably subjected to this core particle formation step, as a dispersion liquid in which the colorant microparticles are dispersed in the aqueous medium.

The dispersion liquid of the colorant microparticles is obtained by dispersing the colorant in the aqueous medium to which a surfactant is added to be set equal to or more than critical micelle concentration (CMC).

A disperser to be used for the dispersion of the colorant is not limited, and preferable examples thereof include pressure dispersers such as an ultrasonic disperser, a mechanical homogenizer, Manton Gaulin and a compression homogenizer, and medium dispersers such as a sand grinder, a Gettman mill and a diamond fine mill.

The average particle diameter of the colorant microparticles in the dispersion liquid of the colorant microparticles is preferably within the range of 10 to 200 nm, for example, in terms of volume-based median diameter. It is noted that the volume-based median diameter is measured using an electrophoretic light scattering photometer "ELS-800" (manufactured by Otsuka Electronics Co., Ltd.).

(Aggregation Agent)

The aggregation agent is not limited, and is selected from metal salts such as alkali metal salts and alkali earth metal salts to be suitably used. Examples of metals of the metal salts include metals of monovalent metal salts, such as sodium, potassium, and lithium; metals of divalent metal salts, such as calcium, magnesium, manganese, and copper; and metals of trivalent metal salts, such as iron, and aluminum. Specific examples of the metal salts include sodium chloride, potassium chloride, lithium chloride, calcium chloride, magnesium chloride, zinc chloride, copper sulfate, magnesium sulfate, and manganese sulfate. Among those, it is particularly preferable to use a divalent metal salt because aggregation can be allowed to proceed with a smaller amount thereof. The aggregation agents can be used singly or in combination.

(4) Shell Layer Formation Step

In this step, the seed polymerization resin microparticles (S) are aggregated on the surface of core particles, and are further fused by heating. Specifically, the seed polymerization resin microparticles (S) are added into the aqueous medium in which the core particles are dispersed, at equal to or more than glass transition points of the vinyl polymer (A) and the vinyl polymer (B) to thereby aggregate and fuse the seed polymerization resin microparticles (S).

In the present invention, it is preferable that, before the time when the core particles in which the resin microparticles (M) and the colorant microparticles are aggregated are fused, the seed polymerization resin microparticles (S) are added into the aqueous medium at a temperature equal to or more than glass transition points of the vinyl polymer (A) and the vinyl polymer (B), and then aggregated and fused.

The addition amount of the seed polymerization resin microparticles (S) is preferably an amount equivalent to 7 to 20% by mass thereof in the toner particles.

The addition amount of the seed polymerization resin microparticles (S) being equal to or more than an amount equivalent to 7% by mass thereof in the toner particles makes it possible to form a shell layer which entirely covers the core particles. On the other hand, the addition amount of the seed polymerization resin microparticles (S) being equal to or less than an amount equivalent to 20% by mass thereof in the toner particles makes it possible to secure high-temperature storability without inhibiting fixability.

It is sufficient for the fusing temperature for fusing the resin microparticles (M) and the seed polymerization resin microparticles (S) to be equal to or more than glass transition points of the vinyl polymer (A) and the vinyl polymer (B); the fusing temperature is particularly set to (glass transition points of the vinyl polymer (A) and the vinyl polymer (B)+10° C.) to (glass transition points of the vinyl polymer (A) and the vinyl polymer (B)+70° C.), and particularly preferably (glass transition points of the vinyl polymer (A) and the vinyl polymer (B)+35° C.) to (glass transition points of the vinyl polymer (A) and the vinyl polymer (B)+60° C.).

(5) Aging Step

The ageing step is conducted as necessary; in this aging step, aging treatment is conducted in which associated particles obtained by the shell layer formation step are aged by thermal energy until a desired shape is obtained to form the toner particles.

The aging treatment is specifically conducted by adjusting the shape of the associated particles depending on the heating temperature, stirring speed, heating time, or the like until the associated particles have desired average circularity, by heating and stirring the system in which the associated particles are dispersed.

(6) Cooling Step

The cooling step is a step in which a dispersion liquid of the toner particles is subjected to a cooling treatment. The preferred condition for the cooling treatment is to cool the dispersion liquid at a cooling rate of 1 to 20° C./min. The specific method for the cooling treatment is not limited, and examples thereof include a method in which a refrigerant is introduced from the outside of a reaction vessel for cooling, and a method in which cold water is directly loaded into the reaction system for cooling.

(7) Filtration/Washing Step

The filtration/washing step is a step in which the toner particles are allowed to undergo solid-liquid separation to be separated from the dispersion liquid of the cooled toner particles, and attached substances such as a surfactant and an aggregation agent are removed from a toner cake (an aggregate of toner particles in a wet state aggregated into a cake shape) obtained via the solid-liquid separation, followed by washing thereof.

For the solid-liquid separation, it is possible to use, but not limited to, a centrifugal separation method, a vacuum filtration method conducted using a nutshe or the like, or a filtration method conducted using a filter press, for example. In addition, in the washing, it is preferable to wash the toner cake with water until the filtrate has an electric conductivity of 10 μs/cm.

(8) Drying Step

The drying step is a step in which the toner cake having undergone the washing treatment is dried, and can be conducted according to the drying step in conventionally known production processes for toner particles. Specific examples of the dryer to be used for drying the toner cake include a spray dryer, a vacuum freeze dryer, and a vacuum dryer; it is preferable to use, for example, a stationary rack dryer, a movable rack dryer, a fluid bed dryer, a rotary dryer and a stirring dryer.

The moisture of the dried toner particles is preferably set to 5% by mass or less, and more preferably 2% by mass or less. It is noted that, when the dried toner particles are aggregated together by weak interparticle attraction, the aggregate may be subjected to a pulverizing treatment. As the pulverizer, it is possible to use a mechanical pulverizer such as a Jet Mill, a Henschel mixer, a coffee mill or a food processor.

The volume-based median diameter of the toner obtained as described above is 3 to 8 μm.

(9) Step of Adding External Additive

While the above-described toner particles can be used as they are as a toner, it is also possible to use the toner particles with an external additive such as so-called a superplasticizer or a cleaning auxiliary being added, in order to improve the fluidity, electrification property, cleaning property, and the like.

Various types of the external additives may be used in combination.

The addition amount of the total of these external additives per 100 parts by mass of the toner particles is preferably 0.05 to 5 parts by mass, and more preferably 0.1 to 3 parts by mass.

As a mixer of the external additive, mechanical mixers such as Henschel mixer and a coffee mill can be used.

According to the above-mentioned process for producing a toner, it is possible to easily produce a toner capable of achieving low-temperature fixability, high-temperature storability and separability as well as smoothness of its surface.

[Developer]

While the toner of the present embodiment can be used as a magnetic or non-magnetic mono-component developer, it may also be used as a two-component developer by mixing it with a carrier. When using the toner as the two-component developer, it is possible to use, as the carrier, magnetic particles made of conventionally known materials like metals such as iron, ferrite and magnetite, and alloys of those metals and metals such as aluminum and lead; in particular, ferrite particles are preferably used. In addition, as the carrier, a coated carrier in which the surface of the magnetic particles is coated with a coating agent such as a resin, or a dispersion type carrier in which magnetic microparticles are dispersed in a binder resin may also be used.

The volume-based median diameter of the carrier is preferably 15 to 100 μm, and more preferably 25 to 80 μm. The volume-based median diameter of the carrier can be measured typically by a laser diffraction particle size distribution measuring apparatus "HELOS" (manufactured by Sympatec Co., Ltd.) equipped with a wet disperser.

Examples of preferred carrier include a resin-coated carrier in which the surface of the magnetic particles is coated with a resin, and a so-called resin-dispersed carrier in which the magnetic particles are dispersed in a resin. The resin constituting the resin-coated carrier is not limited, and examples thereof include an olefinic resin, a styrenic resin, a styrene acrylic resin, an acrylic resin, a silicone resin, an ester resin, and a fluorine-containing polymer resin. In addition, the resin for constituting the resin-dispersed carrier is not limited, and known resin can be used; examples thereof that can be used include an acrylic resin, a styrene acrylic resin, a polyester resin, a fluorine resin and a phenol resin.

[Image Forming Apparatus]

The toner of the present embodiment can be used for a general electrophotographic image formation method. As an image forming apparatus that performs such image formation method, for example, it is possible to use an image forming apparatus including a photoconductor that is an electrostatic latent image carrier, a charging device that gives a uniform electric potential to the surface of the photoconductor with corona discharge having the same polarity as that of the toner, an exposure device that forms an electrostatic latent image by carrying out image exposure on the surface of the uniformly charged photoconductor based on image data, a developing device that conveys the toner to the surface of the photoconductor and visualizes the electrostatic latent image to form a toner image, a transfer device that transfers the toner image onto a recording material, as necessary, via an intermediate transfer member, and a fixing device that thermally fixes the toner image on the recording material.

In addition, the toner of the present embodiment can be suitably used in the device having a relatively low-fixing temperature (surface temperature of fixing member) set at 100° C. to 200° C.

Hereinbefore, the embodiments of the present invention have been specifically described, but the embodiments of the present invention are not limited to the above-described examples, and various modifications can be made thereto.

EXAMPLES

Hereinafter, specific examples of the present invention will be described, but the present invention is not limited thereto.

Preparation Example of Dispersion Liquid of Resin Microparticles MD1

Resin Microparticles Containing Release Agent Therein (First Stage Polymerization)

A solution of 8 g of sodium dodecyl sulfate dissolved in 3 L of ion-exchanged water was charged into a 5 L reaction vessel equipped with a stirrer, a temperature sensor, a condenser, and a nitrogen inlet device, and the internal temperature was raised to 80° C. while stirring the solution at a stirring speed of 230 rpm under a nitrogen stream. Then, a solution of 10 g of potassium persulfate dissolved in 200 g of ion-exchanged water was added, the liquid temperature was raised to 80° C. again, and a monomer liquid mixture composed of:

| | |
|---|---|
| styrene | 480 g; |
| n-butyl acrylate | 250 g; and |
| methacrylic acid | 68 g |

was added dropwise over 1 hour. Subsequently, polymerization was conducted by heating the solution at 80° C. for 2 hours while stirring to prepare a dispersion liquid [A1] of resin microparticles in which resin microparticles [a1] are dispersed.

(Second Stage Polymerization)

A solution of 7 g of polyoxyethylene (2) sodium dodecyl ether sulfate dissolved in 80 ml of ion-exchanged water was charged into a 5 L reaction vessel equipped with a stirrer, a temperature sensor, a condenser, and a nitrogen inlet device, followed by heating to 98° C., and then 260 g of the above-mentioned resin microparticles [a1] and a monomer liquid mixture in which:

| | |
|---|---|
| styrene | 245 g; |
| n-butyl acrylate | 120 g; |
| n-octyl-3-mercapto propionate | 1.5 g; and |
| release agent: behenyl behenate (melting point 73° C.) | 190 g |

were dissolved and mixed at 90° C. were added. Subsequently, mixing and dispersion were conducted for 1 hour using a mechanical disperser having a circulation path "CREARMIX" (M Technique Co., Ltd.) to prepare a dispersion liquid containing emulsified particles (oil droplets).

Next, an initiator solution in which 6 g of potassium persulfate was dissolved in 200 ml of ion-exchanged water was added to the above dispersion liquid, and polymerization was conducted by heating and stirring the system at 82° C. over 1 hour to prepare a dispersion liquid [A2] of resin microparticles in which resin microparticles [a2] are dispersed.

(Third Stage Polymerization)

A solution of 11 g of potassium persulfate dissolved in 400 ml of ion-exchanged water was added to the above-mentioned dispersion liquid [A2] of resin microparticles, and, under the temperature condition of 82° C., a monomer liquid mixture composed of:

| | |
|---|---|
| styrene | 435 g; |
| n-butyl acrylate | 130 g; |
| methacrylic acid | 33 g; and |
| n-octyl-3-mercapto propionate | 8 g |

was added dropwise over 1 hour. After completion of the dropwise addition, polymerization was conducted by heating the solution over 2 hours while stirring, followed by cooling to 28° C., to thereby prepare a dispersion liquid [MD1] of resin microparticles [M1] containing a release agent.

The volume-based median diameter of the resin microparticles [M1] in the dispersion liquid [MD1] was measured to be 220 nm. In addition, the molecular weight of the resin constituting the resin microparticles [M1] was measured to find that the weight-average molecular weight was 59,500.

Preparation Example of Dispersion Liquid of Seed Polymerization Resin Microparticles SD1

Seed Polymerization Resin Microparticles Containing Non-Crystalline Polyester Resin Therein (1) Synthesis of Styrene Acrylic Modified Polyester Resin Into a four-neck flask equipped with a nitrogen inlet tube, a dewatering conduit, a stirrer, and a thermocouple, were fed:

| | |
|---|---|
| ethylene oxide 2 molar adduct of bisphenol A | 500 parts by mass; |
| isophthalic acid | 117 parts by mass; |
| adipic acid | 82 parts by mass; and |
| an esterification catalyst (tin octylate) | 2 parts by mass, |

and a condensation polymerization reaction was conducted at 230° C. for 8 hours, followed by allowing the reaction to further proceed at 8 kPa for 1 hour, followed by cooling to 160° C. Subsequently, a mixture of:

| | |
|---|---|
| acrylic acid | 10 parts by mass; |
| styrene | 30 parts by mass; |
| butyl acrylate | 7 parts by mass; and |
| a polymerization initiator (di-t-butyl peroxide) | 10 parts by mass |

was added dropwise over 1 hour using a dropping funnel After the dropwise addition, the addition polymerization reaction was continued for 1 hour while keeping the temperature at 160° C., followed by raising the temperature to 200° C. and keeping the reaction at 10 kPa for 1 hour, and subsequently the acrylic acid, styrene and butyl acrylate were removed to afford a styrene acrylic modified polyester resin [B1].

The styrene acrylic modified polyester resin [B1] had a glass transition point of 60° C. and a softening point of 105° C.

(2) Preparation of Dispersion Liquid of Non-Crystalline Polyester Resin Microparticles 100 parts by mass of the obtained styrene acrylic modified polyester resin [B1] was pulverized using a pulverizer "Roundel Mill, model: RM" (manufactured by Tokuju Corporation), and was mixed with 638 parts by mass of a sodium lauryl sulfate solution having a concentration of 0.60% by mass which had been prepared in advance, followed by ultrasonic dispersion for 30 minutes using an ultrasonic homogenizer "US-150T" (manufactured by Nisseki Corporation) at V-LEVEL of 300 μA while stirring to thereby prepare a dispersion liquid [BD1] of non-crystalline polyester resin microparticles [B1] having a volume-based median diameter ($D_{50}$) of 70 nm.

(3) Seed Polymerization 2,000 parts by mass of the dispersion liquid [BD1] of the non-crystalline polyester resin microparticles [B1] and 1,150 parts by mass of ion-exchanged water were charged into a 5 L reaction vessel equipped with a stirrer, a temperature sensor, a condenser, and a nitrogen inlet device. A polymerization initiator solution in which 10.3 parts by mass of potassium persulfate was dissolved in 210 parts by mass of ion-exchanged water was further added, and, under the temperature condition of 80° C., a polymerizable monomer liquid mixture composed of:

| | |
|---|---|
| styrene | 350 parts by mass; |
| n-butyl acrylate | 190 parts by mass; |
| methacrylic acid | 60 parts by mass; and |
| n-octyl mercaptan | 8.2 parts by mass; |

was added dropwise over 2 hours, followed by heating and stirring at 80° C. over 2 hours to thereby conduct seed polymerization. After completion of the polymerization, the temperature was cooled to 28° C. to thereby prepare a dispersion liquid [SD1] of seed polymerization resin microparticles [S1] having a volume-based median diameter ($D_{50}$) of 80 nm and containing a non-crystalline polyester resin therein.

Preparation Example of Dispersion Liquid of Seed Polymerization Resin Microparticles SD2

Seed Polymerization Resin Microparticles Containing Non-Crystalline Polyester Resin Therein The dispersion liquid [BD2] of the non-crystalline polyester resin microparticles [B2] having a volume-based median diameter ($D_{50}$) of 149 nm was prepared in the same manner as in the preparation example of the dispersion liquid of the resin microparticles SD1, except using 0.40% by mass (concentration) of a sodium lauryl sulfate solution (active agent) which is used in (2) Preparation of Dispersion Liquid of Non-Crystalline Polyester Resin Microparticles. By using this dispersion liquid [BD2], a dispersion liquid [SD2] of seed polymerization resin microparticles [S2] having a volume-based median diameter ($D_{50}$) of 159 nm and containing a non-crystalline polyester resin therein was prepared.

Preparation Example of Dispersion Liquid of Seed Polymerization Resin Microparticles SD3

Seed Polymerization Resin Microparticles Containing Non-Crystalline Polyester Resin Therein The dispersion liquid [BD3] of the non-crystalline polyester resin microparticles [B3] having a volume-based median diameter ($D_{50}$) of 30 nm was prepared in the same manner as in the preparation example of the dispersion liquid of the resin microparticles SD1, except using 0.80% by mass (concentration) of a sodium lauryl sulfate solution (active agent) which is used in (2) Preparation of Dispersion Liquid of Non-Crystalline Polyester Resin Microparticles. By using this dispersion liquid [BD3], a dispersion liquid [SD3] of seed polymerization resin microparticles [S3] having a volume-based median diameter ($D_{50}$) of 40 nm and containing a non-crystalline polyester resin therein was prepared.

Preparation Example of Dispersion Liquid of Seed Polymerization Resin Microparticles SD4

Seed Polymerization Resin Microparticles Containing Non-Crystalline Polyester Resin Therein The dispersion liquid [BD4] of the non-crystalline polyester resin microparticles [B4] having a volume-based median diameter ($D_{50}$) of 151 nm was prepared in the same manner as in the preparation example of the dispersion liquid of the resin microparticles SD1, except using 0.35% by mass (concentration) of a sodium lauryl sulfate solution (active agent) which is used in (2) Preparation of Dispersion Liquid of Non-Crystalline Polyester Resin Microparticles. By using this dispersion liquid [BD4], a dispersion liquid [SD4] of seed polymerization resin microparticles [S4] having a volume-based median diameter ($D_{50}$) of 161 nm and containing a non-crystalline polyester resin therein was prepared.

Preparation Example of Dispersion Liquid of Crystalline Polyester Resin Microparticles CD 1

(1) Synthesis of Crystalline Polyester Resin

A polyvalent carboxylic acid compound: 300 parts by mass of sebacic acid (molecular weight 202.25) and a polyvalent alcohol compound: 170 parts by mass of 1,6-hexanediol (molecular weight 118.17) were charged into a 5 L reaction vessel equipped with a stirrer, a temperature sensor, a condenser, and a nitrogen inlet device, and the internal temperature was raised to 190° C. over 1 hour while stirring the system to confirm that the system was uniformly stirred. Then, Ti(OBu)4 as a catalyst was loaded in an amount of 0.003% by mass to the charged amount of the polyvalent carboxylic acid compound. Subsequently, the internal temperature was raised from 190 to 240° C. over 6 hours while distilling off generated water, and further a dehydration condensation reaction was continued over 6 hours under the condition of a temperature of 240° C. to conduct polymerization, thereby affording a crystalline polyester resin [C1].

The obtained crystalline polyester resin [C1] had a melting point (Tm) of 83° C. and a number-average molecular weight of 6,300.

(2) Preparation of Dispersion Liquid of Crystalline Polyester Resin Microparticles 30 parts by mass of the crystalline polyester resin [C1] was fused, and conveyed while maintaining the fused state to an emulsifying disperser "CAVITRON CD1010" (manufactured by Eurotec Co., Ltd.) at a conveying rate of 100 parts by mass per minute. Simultaneously with the conveyance of this crystalline polyester resin [C1] in the fused state, dilute ammonia water with a concentration of 0.37% by mass obtained by diluting 70 parts by mass of a reagent ammonia water with ion-exchanged water in an aqueous solvent tank was conveyed to the emulsifying disperser at a conveying rate of 0.1 liter per minute while heating the dilute ammonia water to 100° C. using a heat exchanger. Then, by running the emulsifying disperser at the condition of a rotational speed of a rotator of 60 Hz and a pressure of 5 kg/cm$^2$, a dispersion liquid [CD1] of microparticles of the crystalline polyester resin [C1] having a volume-based median diameter of 200 nm and a solid component amount of 30 parts by mass was prepared.

Preparation Example of Dispersion Liquid of Resin Microparticles for Shell Layer ShD1

100 parts by mass of the styrene acrylic modified polyester resin [B1] obtained in the same manner as described above was pulverized using a pulverizer "Roundel Mill, model: RM" (manufactured by Tokuju Corporation), and was mixed with 638 parts by mass of a sodium lauryl sulfate solution having a concentration of 0.20% by mass which had been prepared in advance, followed by ultrasonic dispersion for 30 minutes using an ultrasonic homogenizer "US-150T" (manufactured by Nisseki Corporation) at V-LEVEL of 300 μA while stirring to thereby prepare a dispersion liquid [ShD1] of non-crystalline polyester resin microparticles [B1] having a volume-based median diameter ($D_{50}$) of 200 nm.

Preparation Example of Dispersion Liquid of Colorant Microparticles Bk 90 parts by mass of polyoxyethylene-2-dodecyl ether sodium sulfate was dissolved in 1,510 parts by mass of ion-exchanged water while stirring. While stirring this solution, 400 parts by mass of carbon black "REGAL 330" (manufactured by Cabot Corporation) was added gradually, and then a dispersion treatment was conducted using a stirrer "CLEARMIX" (manufactured by M technique Co., Ltd.), to thereby afford a dispersion liquid [BK] of colorant microparticles.

The volume-based median diameter of the colorant microparticles in the dispersion liquid [BK] of the colorant microparticles was measured to be 110 nm.

Toner Production Example 1

Example 1

2,500 parts by mass of ion-exchanged water, 750 parts by mass (in terms of solid content) of the dispersion liquid

[MD1] of the resin microparticles [M1] containing a release agent, and 100 parts by mass of the dispersion liquid [Bk] of the colorant microparticles were charged into a zebra flask equipped with a stirrer, a temperature sensor, a condenser, and a nitrogen inlet device. After the liquid temperature was adjusted to 25° C., an aqueous sodium hydroxide solution with a concentration of 25% by mass was added to adjust the pH to 10.

Next, at a stirring speed of 300 rpm, an aqueous solution in which 54.3 parts by mass of magnesium chloride hexahydrate was dissolved in 54.3 parts by mass of ion-exchanged water was added, and subsequently the temperature of the system was raised to 97° C., with the stirring speed being set to 120 rpm, to thereby initiate the aggregation reaction between the resin microparticles and the colorant microparticles.

After the initiation of the aggregation reaction, sampling was periodically conducted to measure the volume-based median diameter of the particles using a particle size distribution measuring apparatus "Coulter Multisizer 3" (manufactured by Beckman Coulter, Inc.). When the volume-based median diameter was 6 μm, the stirring speed was set to 300 rpm.

Subsequently, 150 parts by mass (in terms of solid content) of the dispersion liquid [SD1] of the seed polymerization resin microparticles [S1] containing a non-crystalline polyester resin therein were loaded over 30 minutes. When the supernatant of the reaction liquid became transparent, an aqueous solution in which 190 parts by mass of sodium chloride was dissolved in 760 parts by mass of ion-exchanged water was added to stop the growth of the particles. Further, the temperature was raised at the same stirring speed to 90° C. to thereby allow the fusing of particles to proceed. When the average circularity was 0.945 which was measured using an apparatus for measuring the toner average circularity, "FPIA-2100" (manufactured by Sysmex Corporation) (with HPF detection number of 4,000), the temperature was cooled to 30° C. to afford the dispersion liquid of the toner particles.

The dispersion liquid of the toner particles thus obtained was allowed to undergo solid-liquid separation using a basket-shaped centrifugal separator "MARK III, model No. 60×40" (manufactured by Matsumoto Machine Co., Ltd.) to form a wet cake. The wet cake was allowed to undergo repetitive washing and solid-liquid separation until the electric conductivity of the filtrate reached 15 μS/cm using the basket-shaped centrifugal separator. Subsequently, a stream having a temperature of 40° C. and a humidity of 20% RH was blown using "Flash Jet Dryer" (manufactured by Seishin Enterprise Co., Ltd.) to thereby conduct a drying treatment of toner particles until the moisture amount was 0.5% by mass, followed by cooling to 24° C. to afford toner particles [1X].

1% by mass of hydrophobic silica particles and 1.2% by mass of hydrophobic titanium oxide particles were added to the obtained toner particles [1X], followed by mixing over 20 minutes using a Henschel mixer under the condition of a circumferential speed of a rotary blade of 24 m/s, and further an external additive was added by allowing it to pass through a 400-mesh sieve to afford toner [1].

The glass transition point of the obtained toner [1] was measured to be 37° C.

It is noted that, in the toner [1], the addition of hydrophobic silica particles and hydrophobic titanium oxide particles did not change the shape and the particle diameter of the toner particles.

Toner Production Example 2

Example 2

The operations were conducted in the same manner as in the toner production example 1 until the initiation of the aggregation reaction.

After the initiation of the aggregation reaction, sampling was periodically conducted to measure the volume-based median diameter of the particles using a particle size distribution measuring apparatus "Coulter Multisizer 3" (manufactured by Beckman Coulter, Inc.). When the volume-based median diameter was 5 μm, the stirring speed was set to 300 rpm, and 150 parts by mass (in terms of solid content) of the dispersion liquid [SD1] of the seed polymerization resin microparticles [S1] containing the non-crystalline polyester resin therein was loaded. The particles were allowed to grow until the particles had a volume-based median diameter of 6 μm with the stirring speed being lowered to 200 rpm, and the stirring speed was again increased to 300 rpm.

When the volume-based median diameter of the particles was 6 μm, an aqueous solution in which 190 parts by mass of sodium chloride was dissolved in 760 parts by mass of ion-exchanged water was added to stop the growth of the particles.

The subsequent operations were conducted in the same manner as in the toner production example 1 to afford toner [2].

Toner Production Examples 3 and 4

Examples 3 and 4

Toners [3] and [4] were obtained in the same manner as in the toner production example 1 except following the formulation in Table 1.

Toner Production Example 5

Example 5

Toner [5] was obtained in the same manner as in the toner production example 1 except that 600 parts by mass (in terms of solid content) of the dispersion liquid [MD1] of the resin microparticles [M1] containing a release agent and 150 parts by mass (in terms of solid content) of the dispersion liquid [CD1] of the crystalline polyester resin [C1] microparticles were used, in place of 750 parts by mass (in terms of solid content) of the dispersion liquid [MD1] of the resin microparticles [M1] containing a release agent.

Toner Production Example 6

Comparative Example 1

The operations were conducted in the same manner as in the toner production example 1 until the initiation of the aggregation reaction.

After the initiation of the aggregation reaction, sampling was periodically conducted to measure the volume-based median diameter of the particles using a particle size distribution measuring apparatus "Coulter Multisizer 3" (manufactured by Beckman Coulter, Inc.). When the volume-based median diameter was 3.5 μm, the stirring speed was set to 300 rpm, and 150 parts by mass (in terms of solid content) of the dispersion liquid [SD1] of the seed polymerization resin microparticles [S1] containing the non-crystalline polyester resin therein was loaded. The particles were allowed to grow until they had a volume-based median diameter of 6 μm with the stirring speed being lowered to 200 rpm, and the stirring speed was again increased to 300 rpm.

When the volume-based median diameter of the particles was 6 μm, an aqueous solution in which 190 parts by mass of sodium chloride was dissolved in 760 parts by mass of ion-exchanged water was added to stop the growth of the particles.

The subsequent operations were conducted in the same manner as in the toner production example 1 to afford toner [6].

Toner Production Example 7

Comparative Example 2

Toner [7] was obtained in the same manner as in the toner production example 1 except following the formulation in Table 1.

Toner Production Example 8

Comparative Example 3

Toner [8] was obtained in the same manner as in the toner production example 1 except that the addition amount of the dispersion liquid [MD1] of the resin microparticles [M1] containing a release agent was changed to 750 parts by mass (in terms of solid content), and further that the dispersion liquid [ShD1] of the resin microparticles for a shell layer [Sh1] was used, in place of the dispersion liquid [SD1] of the seed polymerization resin microparticles [S1] containing the non-crystalline polyester resin therein.

For the above-mentioned toners [1] to [8], the number-average domain diameter of domain phases composed of the non-crystalline polyester resin and the ratio of the domain phases localized in the surface layer area were measured, as described above. The results are shown in Table 1.

Production Examples of Developers 1 to 8

A ferrite carrier having a volume-based median diameter of 60 μm and being coated with a silicone resin was added to each of the toners [1] to [8] so that the toner concentration is 6% by mass, followed by mixing using a V-type mixer to thereby produce developers [1] to [8].

(1) Low-temperature Fixability

A commercially-available full-color multifunctional machine "bizhub PRO C6500" (manufactured by Konica Minolta, Inc.) modified to be able to change the surface temperatures of a fixing upper belt and a fixing lower roller was used as an image forming apparatus, and each of the developers [1] to [8] was loaded as a developer. A test of outputting a solid image having a toner deposition amount of 11.3 g/m$^2$ on a recording material "NPi wood-free paper 128 g/m$^2$" (manufactured by Nippon Paper Industries Co., Ltd.) at a fixing temperature of 200° C. and at a fixing rate of 300 mm/sec was repeated until cold offset occurred while changing the fixing temperature so as to be reduced by decrements of 5° C. The lowest surface temperature of the fixing upper belt at which the cold offset did not occur was examined, and this temperature was set as the minimum fixing temperature to evaluate the low-temperature fixability. In each of the tests, the fixing temperature means a surface temperature of the fixing upper belt, whereas the surface temperature of the fixing lower roller was constantly set as a temperature 20° C. lower than the surface temperature of the fixing upper belt. The results are shown in Table 1. The lower minimum fixing temperature indicates more excellent low-temperature fixability. In the present invention, the fixing temperature of 125° C. or lower is judged to be acceptable.

(2) Separability

A modified version of "bizhub C6500" (manufactured by Konica Minolta, Inc.) was used to repeat a test of outputting an overall solid image having a toner deposition amount of 4.0 g/m$^2$ on a recording material "Kinfuji 85 g/m$^2$ long grain" (manufactured by Oji Paper Co., Ltd.) having been left to stand overnight in an environment of normal temperature and normal humidity (temperature of 25° C. and humidity of 50% RH) to be conditioned in humidity, in the environment of normal temperature and normal humidity (temperature of 25° C. and humidity of 50% RH) and at a fixing temperature of the upper belt of 195° C. with the lower roller being 120° C., with an end margin being set to 8 mm, until paper jam occurred while changing the end margin so as to be reduced in a manner of 7 mm, 6 mm, . . . by a unit of 1 mm. The minimum end margin in which the paper jam did not occur was examined to thereby evaluate separability. The results are shown in Table 1. The smaller minimum end margin indicates more excellent separability. In the present invention, the end margin of 5 mm or less is judged to be acceptable.

(3) High-Temperature Storability 0.5 g of toner was taken into a 10-ml glass bottle with an internal diameter of 21 mm, and the bottle was capped. The bottle was shaken 600 times at room temperature using a shaker "Tap Denser KYT-2000" (manufactured by Seishin Enterprise Co., Ltd.), and then the bottle was uncapped and left to stand for 2 hours under the environment of a temperature of 55° C. and a humidity of 35% RH. Subsequently, the aggregate of the toner was carefully placed on a 48-mesh sieve (aperture 350 μm) so as not to pulverize the aggregate, and was set on "Powder Tester" (Hosokawa Micron Corporation). The toner was fixed by a press bar and a knob nut, and the tester was adjusted to have a vibration intensity equivalent to the feeding width of 1 mm. After vibration was applied for 10 seconds, the ratio (% by mass) of the amount of the toner remaining on the sieve was measured to calculate the toner aggregation ratio according to the requirement set forth below. This test was repeated, with the humidity being maintained at 35% RH while increasing the test temperature by increments of 0.1° C., until the toner aggregation ratio exceeded 50% by mass. The maximum test temperature at which the toner aggregation ratio did not exceed 50% by mass (marginal heat-resistant storable temperature) was set as an index of the high-temperature storability.

In the present invention, the marginal heat-resistant storable temperature of 56.5° C. or higher is judged to be acceptable. The results are shown in Table 1.

Toner aggregation ratio (% by mass)=mass of toner remaining on sieve (g)/0.5 (g)×100

TABLE 1

| | | Ex. 1 Toner [1] | Ex. 2 Toner [2] | Ex. 3 Toner [3] | Ex. 4 Toner [4] | Ex. 5 Toner [5] | Comp. Ex. 1 Toner [6] | Comp. Ex. 2 Toner [7] | Comp. Ex. 3 Toner [8] |
|---|---|---|---|---|---|---|---|---|---|
| Dispersion Liquid of Resin Microparticles (M) | Type | MD1 | MD1 | MD1 | MD1 | MD1 | MD1 | MD1 | MD1 |
| | Parts by Mass | 750 | 750 | 750 | 750 | 600 | 750 | 750 | 750 |
| Dispersion Liquid of Crystalline PEs Resin Microparticles | Type | — | — | — | — | CD1 | — | — | — |
| | Parts by Mass | — | — | — | — | 150 | — | — | — |
| Dispersion Liquid of Seed Polymerization Resin Microparticles (S) | Type | SD1 | SD1 | SD2 | SD3 | SD1 | SD1 | SD4 | — |
| | Parts by Mass | 150 | 150 | 150 | 150 | 150 | 150 | 150 | — |
| | Concentration of Active Agent | 0.6% | 0.6% | 0.4% | 0.8% | 0.6% | 0.6% | 0.35% | — |
| | Particle Diameter of Seed Particles | 70 nm | 70 nm | 149 nm | 30 nm | 70 nm | 70 nm | 151 nm | — |
| | Particle Diameter | 80 nm | 80 nm | 159 nm | 40 nm | 80 nm | 80 nm | 161 nm | — |
| Dispersion Liquid of Resin Microparticles for Shell Layer | Type | — | — | — | — | — | — | — | ShD1 |
| | Parts by Mass | — | — | — | — | — | — | — | 150 |
| | Particle Diameter | — | — | — | — | — | — | — | 200 nm |
| Dispersion Liquid of Colorant Microparticles | Type | Bk | Bk | Bk | Bk | Bk | Bk | Bk | Bk |
| | Parts by Mass | 100 | 100 | 100 | 100 | 100 | 100 | 100 | 100 |
| Evaluation Results | Number-Average Domain Diameter of Domain Phase Composed of Non-Crystalline PEs Resin | 70 nm | 70 nm | 139 nm | 30 nm | 70 nm | 70 nm | 151 nm | — |
| | Ratio of Domain Phases Localized in Surface Layer Area | 90% | 80% | 90% | 90% | 90% | 70% | 90% | 70% |
| | Low-Temperature Fixability | 125° C. | 125° C. | 125° C. | 125° C. | 120° C. | 125° C. | 125° C. | 130° C. |
| | High-Temperature Storability | 57° C. | 56.8° C. | 57° C. | 57° C. | 56.8° C. | 55.0° C. | 56.8° C. | 55.0° C. |
| | Separability (End Margin) | 1 mm | 1 mm | 3 mm | 1 mm | 1 mm | 1 mm | 7 mm | 7 mm |

What is claimed is:

1. A toner for developing an electrostatic latent image, comprising:

toner particles including a binder resin, a colorant, and a release agent, the binding resin including a vinyl resin and a non-crystalline polyester resin, wherein, the toner particles include a matrix phase composed of a vinyl resin, and domain phases composed of a non-crystalline polyester resin dispersed in the matrix phase, a number-average domain diameter of the domain phases composed of the non-crystalline polyester resin is 30 to 150 nm, and the toner satisfies the following Requirement (1):

$$a/(a+b)\times 100(\%)>80(\%) \qquad \text{Requirement (1):}$$

where when "r" is defined as an average radius of a cross-section, having a maximum area, of the toner particle, "a" represents a total area, in the cross-section, of the domain phases composed of the non-crystalline polyester resin present in a surface layer area having a distance of r/5 inwardly in a radial direction from a surface of the toner particle, and "b" represents a total area, in the cross-section, of the domain phases composed of the non-crystalline polyester resin present in areas other than the surface layer area.

2. The toner according to claim 1, wherein the binder resin comprises a crystalline polyester resin.

3. The toner according to claim 1, wherein a number-average domain diameter of the domain phases composed of the non-crystalline polyester resin is 60 to 100 nm.

4. The toner according to claim 1, wherein a ratio of the domain phases localized in the surface layer area is 90% or more.

5. The toner according to claim 1, wherein a weight-average molecular weight (Mw) of the vinyl resin is 20,000 to 60,000.

6. The toner according to claim 1, wherein a glass transition point of the vinyl resin is 40 to 60° C.

7. The toner according to claim 1, wherein a content ratio of the vinyl resin in the binder resin is 65 to 95% by mass.

8. The toner according to claim 1, wherein a weight-average molecular weight (Mw) of the non-crystalline polyester resin is 1,500 to 60,000.

9. The toner according to claim 8, wherein a weight-average molecular weight (Mw) of the non-crystalline polyester resin is 3,000 to 40,000.

10. The toner according to claim 1, wherein a glass transition point of the non-crystalline polyester resin is 45 to 70° C.

11. The toner according to claim 1, wherein the non-crystalline polyester resin is a vinyl-modified non-crystalline polyester resin in which a vinyl polymerization segment and a non-crystalline polyester polymerization segment are bonded, and a content ratio of the vinyl polymerization segment in the vinyl-modified non-crystalline polyester resin is 7 to 20% by mass.

12. The toner according to claim 1, wherein a content ratio of the non-crystalline polyester resin in the binder resin is 10 to 20% by mass.

13. The toner according to claim 1, wherein a number-average domain diameter of domain phases composed of the release agent is 100 to 2,000 nm.

14. The toner according to claim 1, wherein a content ratio of the release agent is 4 to 15 parts by mass per 100 parts by mass of the binder resin.

15. A process for producing the toner according to claim 1, comprising:

(1) producing resin microparticles including a vinyl polymer containing a release agent;

(2) adding a vinyl monomer to an aqueous medium in which non-crystalline polyester resin microparticles having a volume-based median diameter of 30 to 150 nm are dispersed, and conducing seed polymerization with the vinyl monomer using the non-crystalline polyester resin microparticles as seed particles to produce seed polymerization resin microparticles having a volume-based median diameter of 40 to 160 nm in which the non-crystalline polyester resin microparticles are coated with the vinyl polymer;

(3) aggregating the resin microparticles with colorant microparticles in an aqueous medium to produce core particles; and (4) aggregating and fusing the seed polymerization resin microparticles on a surface of the core particles to form a shell layer, wherein a volume-based median diameter of toner particles constituting the toner is 3 to 8 μm.

16. The process according to claim 15, wherein the seed polymerization resin microparticles are added in such an amount that a content ratio of the seed polymerization resin microparticles in the toner particles to be obtained is 7 to 20% by mass.

* * * * *